US007322532B2

(12) United States Patent
Takada et al.

(10) Patent No.: US 7,322,532 B2
(45) Date of Patent: Jan. 29, 2008

(54) HOT-WATER SUPPLY APPARATUS, ANTI-FREEZING METHOD THEREOF, AND ANTI-FREEZING PROGRAM THEREOF

(75) Inventors: Akira Takada, Fuji (JP); Akihito Yamashita, Fuji (JP); Katsumi Naitoh, Fuji (JP)

(73) Assignee: Takagi Industrial Co., Ltd., Shizuoka (JP)

( * ) Notice: Subject to any disclaimer, the term of this patent is extended or adjusted under 35 U.S.C. 154(b) by 521 days.

(21) Appl. No.: 11/056,282

(22) Filed: Feb. 14, 2005

(65) Prior Publication Data

US 2006/0026974 A1 Feb. 9, 2006

(30) Foreign Application Priority Data

Aug. 6, 2004 (JP) ..... 2004-231650

(51) Int. Cl.
*F24H 9/20* (2006.01)
*B60H 1/00* (2006.01)

(52) U.S. Cl. ..... 236/11; 237/8 A; 122/14.2; 62/150

(58) Field of Classification Search ..... 236/11; 237/2 A, 7, 8 A, 19; 122/14.1, 14.2; 62/150
See application file for complete search history.

(56) References Cited

U.S. PATENT DOCUMENTS 4,501,261 A * 2/1985 Tsutsui et al. ..... 122/14.3
5,203,500 A * 4/1993 Horne, Sr. ..... 237/19
6,606,968 B2 * 8/2003 Iwama et al. ..... 122/18.1

FOREIGN PATENT DOCUMENTS

JP 04302921 A * 10/1992
JP 10-26413 1/1998
JP 10-227526 8/1998
JP 11-159874 6/1999
JP 2003-207207 7/2003

* cited by examiner

*Primary Examiner*—Marc Norman
(74) *Attorney, Agent, or Firm*—Connolly Bove Lodge & Hutz LLP

(57) ABSTRACT

A hot-water supply apparatus is an apparatus which has a primary heat exchanger absorbing sensible heat of combustion exhaust and a secondary heat exchanger absorbing latent heat of the combustion exhaust, and improves a freezing prevention function of the hot-water supply apparatus at a cold period. Further, this apparatus has a temperature detection means (temperature sensors) which detects a freezing prevention temperature, a combustion means (a burner group) which supplies combustion exhaust generated by combustion to the primary and secondary heat exchangers, an air supply means which supplies air to the combustion means, and a control means (a control unit) which makes the combustion means burn and drives the air supply means based on a detected temperature of the temperature detection means. When the temperature detection means detects the freezing prevention temperature, the combustion means is burned for a settled time to heat the primary heat exchanger, and the air supply means is driven to stream air from a side of the primary heat exchanger to the secondary heat exchanger for a given time after a combustion stop of the combustion means. By this, a side of the secondary heat exchanger is heated by remaining heat of the side of the primary heat exchanger.

22 Claims, 13 Drawing Sheets

HOT-WATER SUPPLY APPARATUS, ANTI-FREEZING METHOD THEREOF, AND ANTI-FREEZING PROGRAM THEREOF

BACKGROUND OF THE INVENTION

1. Field of the Invention

The present invention relates to a hot-water supply apparatus which heats water to supply hot water. In particular, it relates to the prevention of freezing of a water pipe and so on at a cold period.

2. Description of the Related Art

In a hot-water supply apparatus which makes a heat source by burning a fuel gas, an entrance water temperature is detected by providing an entrance water temperature sensor in a water pipe. When an entrance water temperature below a set value is detected, a power source is given to a heater which is installed at the water pipe, and the water pipe is heated by the heater. By this, freezing in the water pipe is prevented. Further, in a hot-water supply apparatus which is installed in the inside of a house, since cold air enters from an exhaust pipe and so on, a fall in temperature is detected by a hot-water temperature sensor, and a heater is driven. By this, the prevention of freezing is designed to be performed.

In connection with the like of anti-freezing of a hot-water supply apparatus, the Japanese Laid Open Publications No. 10-26413, No. 10-227526, No. 11-159874 and No. 2003-207207 are in existence. The publication No. 10-26413 discloses a hot water feeding device in which combustion is started when a detected value of a hot-water temperature sensor becomes a temperature below a threshold value, and the combustion is maintained until the hot-water temperature sensor detects a value above the threshold value. In the publication No. 10-227526, combustion is put ON/OFF according to a detected value of a hot-water temperature/entrance-water temperature sensor, and freezing of a water pipe which is nearer an exit than a heat exchanger is prevented by making a heater operate based on a temperature-sensitive sensor. Further, the publication No.11-159874 discloses a method which confirms the presence/absence of freezing, for example, at the time when a power source is supplied for the first time. This publication discloses that combustion for the prevention of freezing is performed if an outgoing hot-water temperature and/or an entrance water temperature as an example becomes a temperature below a threshold value, this method decides on freezing if a temperature does not rise, and the combustion is stopped after this. Furthermore, the publication No. 2003-207207 discloses a method which heats a water pipe by driving a heater and a fan if a temperature sensor detects a freezing temperature.

By the way, in the United States of America and so on where mounting a draft hood on an exhaust pipe provided to a hot-water supply apparatus is not permitted, cold air which invades an exhaust pipe by an adverse wind refrigerates a heat exchanger at a cold period. Because of this, freezing is generated in a water pipe. Even if a heater is provided to the water pipe and it is heated, it is impossible to prevent the freezing if an ambient temperature falls extremely.

Further, in a high-efficiency hot-water supply apparatus which has a secondary heat exchanger absorbing latent heat from combustion exhaust passed through a primary heat exchanger, there is no space to attach a heater because the whole of the heat exchanger is surrounded by a radiation shield. Because of this, there is a method which prevents freezing by sending indoor air by means of a fan motor. However, even if the indoor air is sent, keeping warmth of the side of the secondary heat exchanger becomes insufficient because heat is absorbed by a side of the primary heat exchanger. Hence, it is feared that freezing of the side of the secondary heat exchanger can not be prevented.

The problems mentioned above are not disclosed in the publications No. 10-26413, No. 10-227526, No. 11-159874 and No. 2003-207207. Therefore, these problems can not be solved even if the technology disclosed in these patent documents is used.

SUMMARY OF THE INVENTION

In order to solve the above-mentioned problems, an object of the present invention is to improve a freezing prevention function of a hot-water supply apparatus at a cold period.

Further, another object of the present invention is to improve a freezing prevention function of a high-efficiency hot-water supply apparatus which has a primary heat exchanger absorbing sensible heat of combustion exhaust and a secondary heat exchanger absorbing latent heat of the combustion exhaust.

In order to attain the above objects, a hot-water supply apparatus of the present invention has a primary heat exchanger, which absorbs sensible heat of combustion exhaust generated by combustion of fuel, and a secondary heat exchanger which absorbs latent heat of the combustion exhaust, and is the following constitution. The hot-water supply apparatus comprises a temperature detection means which detects a temperature of an inside of the hot-water supply apparatus, a combustion means which supplies the combustion exhaust to the primary heat exchanger and the secondary heat exchanger, an air supply means which supplies air to the combustion means, and a control means which makes the combustion means burn and drives the air supply means based on a detected temperature of the temperature detection means. Further, a freezing prevention temperature which forms reference of a start of freezing prevention operation is set for the control means, and, in case where a detected temperature of the temperature detection means reaches the freezing prevention temperature, the control means makes the combustion means burn for a settled time to heat the primary heat exchanger, and drives the air supply means to stream air from a side of the primary heat exchanger to the secondary heat exchanger for a given time after a combustion stop of the combustion means.

In a constitution like this, the primary heat exchanger, the secondary heat exchanger, the combustion means and the air supply means are a constitution that is provided for an existing hot-water supply apparatus. In the present invention, by the temperature detection means detecting the freezing prevention temperature and the control means using a detected temperature of the temperature detection means for control information, the combustion of the combustion means is controlled, the air supply means is continuously driven also after its combustion, and the prevention of freezing is designed to be performed. That is, in case where the temperature detection means detects the freezing prevention temperature, the combustion means is burned for the settled time, and the primary heat exchanger is heated. The air supply means is driven for the given time after the combustion stop of the combustion means, and air is streamed from the side of the primary heat exchanger to the secondary heat exchanger. As a result of this, heat (remaining heat) which is stored in the side of the primary heat exchanger by the combustion of the combustion means flows into the secondary heat exchanger together with the air, and a side of the secondary heat exchanger is heated. By this, the efficient prevention of freezing is designed to be given.

In order to attain the above objects, the hot-water supply apparatus of the present invention may also be constituted so that a side of the secondary heat exchanger is heated by means of remaining heat, which a side of the primary heat exchanger has, by streaming air from the side of the primary heat exchanger to the secondary heat exchanger. Further, the hot-water supply apparatus of the present invention may also be constituted so that the temperature detection means detects a temperature of a water pipe which the primary heat exchanger or the secondary heat exchanger has, or so that the temperature detection means detects a temperature of a water pipe which is connected to the primary heat exchanger or the secondary heat exchanger.

In order to attain the above objects, the hot-water supply apparatus of the present invention may also be constituted so that the hot-water supply apparatus has heaters which heat a water pipe supplying water to the primary heat exchanger and the secondary heat exchanger, and a temperature detection means which detects a temperature of a space of an inside of a housing of the hot-water supply apparatus, and so that the control means feeds the heaters to heat the water pipe in case where a detected temperature of the space of the inside of the housing by means of the temperature detection means reaches the freezing prevention temperature. That is, the prevention of freezing is designed to be performed by heating the water pipe by means of electric heating by the heaters.

In order to attain the above objects, the hot-water supply apparatus of the present invention may also be constituted so that a drive time of the air supply means is controlled according to the detected temperature of the temperature detection means. Further, the hot-water supply apparatus of the present invention may also be constituted so that the hot-water supply apparatus has a temperature detection means which detects a temperature of a space in which the hot-water supply apparatus is installed, and an air supply means which supplies air of the space to the combustion means, and so that the control means drives the air supply means to stream the air of the space to the primary heat exchanger and the secondary heat exchanger in case where the temperature of the space is higher than the freezing prevention temperature.

In order to attain the above objects, a hot-water supply apparatus of the present invention has a primary heat exchanger, which absorbs sensible heat of combustion exhaust generated by combustion of fuel, and a secondary heat exchanger which absorbs latent heat of the combustion exhaust, and may also be constituted as described in the following. This hot-water supply apparatus comprises a first temperature detection means which detects a temperature of a water pipe of an entrance water side, a second temperature detection means which detects a temperature of a water pipe of an outgoing hot-water side, a combustion means which supplies the combustion exhaust to the primary heat exchanger and the secondary heat exchanger, an air supply means which supplies air to the combustion means, and a control means which makes the combustion means burn and drives the air supply means based on a detected temperature of the first temperature detection means or the second temperature detection means. Further, a freezing prevention temperature which forms reference of a start of freezing prevention operation is set for the control means, and, in case where either a detected temperature of the first temperature detection means or a detected temperature of the second temperature detection means reaches the freezing prevention temperature, or in case where both of them reach the freezing prevention temperature, the control means makes the combustion means burn for a settled time to heat the primary heat exchanger, and drives the air supply means to stream air from a side of the primary heat exchanger to the secondary heat exchanger for a given time after a combustion stop of the combustion means.

In a constitution like this, the first and second temperature detection means are used as a temperature detection means which detects the freezing prevention temperature. The first temperature detection means detects a temperature of the water pipe of the entrance water side, and the second temperature detection means detects a temperature of the water pipe of the outgoing hot-water side. This is constituted so that the first and second temperature detection means take charge of such regions of temperature detection divisionally, and so that the combustion means and the air supply means are controlled by using these detected temperatures for control information. In case where either the first temperature detection means or the second temperature detection means detects the freezing prevention temperature, or in case where both of them detect the freezing prevention temperature, the control means makes the combustion means burn for the settled time to heat the primary heat exchanger. Then, the control means drives the air supply means to stream the air from the side of the primary heat exchanger to the secondary heat exchanger for the given time after the combustion stop of the combustion means. As a result of this, it is possible to heat a side of the secondary heat exchanger by remaining heat of the primary heat exchanger side, and thereby the efficient prevention of freezing is designed to be given.

In order to attain the above objects, an anti-freezing method of a hot-water supply apparatus according to the present invention is an anti-freezing method of a hot-water supply apparatus having a primary heat exchanger, which absorbs sensible heat of combustion exhaust generated by combustion of fuel, and a secondary heat exchanger which absorbs latent heat of said combustion exhaust, and is constituted as described in the following. This anti-freezing method includes processing that sets a freezing prevention temperature which forms reference of a start of freezing prevention operation, processing that detects a temperature of an inside of the hot-water supply apparatus, processing that supplies combustion exhaust, which is generated at a combustion means by combustion of fuel, to the primary heat exchanger and the secondary heat exchanger, processing that supplies air necessary for combustion to the combustion means by an air supply means, and processing that makes the combustion means burn for a settled time to heat the primary heat exchanger in case where the freezing prevention temperature is detected, and drives the air supply means to stream air from a side of the primary heat exchanger to the secondary heat exchanger for a given time after a combustion stop of the combustion means. By a constitution like this, the efficient prevention of freezing described before is designed to be given.

In order to attain the above objects, the anti-freezing method of the hot-water supply apparatus according to the present invention may also be constituted so that a side of the secondary heat exchanger is heated by means of remaining heat, which a side of the primary heat exchanger has, by streaming air from the side of the primary heat exchanger to the secondary heat exchanger. Further, the anti-freezing method of the present invention may also be constituted so that the freezing prevention temperature is detected by a temperature of a water pipe which the primary heat exchanger or the secondary heat exchanger has, or so that the freezing prevention temperature is detected by a temperature of a water pipe which is connected to the primary heat exchanger or the secondary heat exchanger.

In order to attain the above objects, the anti-freezing method of the hot-water supply apparatus according to the present invention may also be constituted so that the temperature of the inside of the hot-water supply apparatus is a temperature of a space of an inside of a housing of the hot-water supply apparatus, and so that this anti-freezing method further includes processing that heats a water pipe supplying water to the primary heat exchanger and the secondary heat exchanger by electric heating in case where the temperature of the space of the inside of the housing of the hot-water supply apparatus reaches the freezing prevention temperature. That is, it is possible to heat the water pipe by means of electric heating by a heater, and thereby the higher prevention of freezing is designed to be given.

In order to attain the above objects, the anti-freezing method of the hot-water supply apparatus according to the present invention may also be constituted so that the anti-freezing method further includes processing that makes a drive time of the air supply means increase/decrease according to a detected temperature of the inside of the hot-water supply apparatus. Further, the anti-freezing method of the present invention may also be constituted so that the anti-freezing method further includes processing that streams air of a space, in which the hot-water supply apparatus is installed, to the primary heat exchanger and the secondary heat exchanger in case where a temperature of the space is higher than the freezing prevention temperature.

In order to attain the above objects, an anti-freezing method of a hot-water supply apparatus according to the present invention is an anti-freezing method of a hot-water supply apparatus having a primary heat exchanger, which absorbs sensible heat of combustion exhaust generated by combustion of fuel, and a secondary heat exchanger which absorbs latent heat of said combustion exhaust, and may also be constituted as described in the following. This anti-freezing method includes processing that sets a freezing prevention temperature which forms reference of a start of freezing prevention operation, processing that detects a first temperature of a water pipe of an entrance water side, processing that detects a second temperature of a water pipe of an outgoing hot-water side, processing that supplies combustion exhaust, which is generated at a combustion means by combustion of fuel, to the primary heat exchanger and the secondary heat exchanger, processing that supplies air necessary for combustion to the combustion means by an air supply means, and processing that makes the combustion means burn for a settled time to heat the primary heat exchanger in case where either the first temperature or the second temperature reaches the freezing prevention temperature, or in case where both of them reach the freezing prevention temperature, and drives the air supply means to stream air from a side of the primary heat exchanger to the secondary heat exchanger for a given time after a combustion stop of the combustion means. Also by a constitution like this, the efficient prevention of freezing described before is designed to be given.

In order to attain the above objects, an anti-freezing program of a hot-water supply apparatus according to the present invention is an anti-freezing program of a hot-water supply apparatus having a primary heat exchanger, which absorbs sensible heat of combustion exhaust generated by combustion of fuel, and a secondary heat exchanger which absorbs latent heat of said combustion exhaust, and is a constitution which makes a computer execute the following steps. This anti-freezing program includes a step that obtains a temperature data of an inside of the hot-water supply apparatus, which is detected by a temperature detection means, a step that makes a comparison between a temperature of the inside of the hot-water supply apparatus and a freezing prevention temperature which forms reference of a start of freezing prevention operation, a step that drives a combustion means for a settled time for the purpose of heating the primary heat exchanger in case where the temperature of the inside of the hot-water supply apparatus reaches the freezing prevention temperature, and a step that drives an air supply means for a given time after a stop of drive of the combustion means for the purpose of streaming air from a side of the primary heat exchanger to the secondary heat exchanger.

In order to attain the above objects, the anti-freezing program of the hot-water supply apparatus according to the present invention may also be constituted so that the temperature data of the inside of the hot-water supply apparatus, which is detected by the temperature detection means, is a temperature data of a water pipe which the primary heat exchanger or the secondary heat exchanger has, or so that the temperature data is a temperature data of a water pipe which is connected to the primary heat exchanger or the secondary heat exchanger. The anti-freezing program of the present invention may also be constituted so that the temperature data of the inside of the hot-water supply apparatus, which is detected by the temperature detection means, is a temperature data of a space of an inside of a housing of the hot-water supply apparatus, and so that this anti-freezing program further includes a step that drives heaters heating a water pipe supplying water to the primary heat exchanger and the secondary heat exchanger in case where a temperature of the space of the inside of the housing of the hot-water supply apparatus reaches the freezing prevention temperature. Further, the anti-freezing program of the present invention may also be constituted so that this anti-freezing program further includes a step that makes a drive time increase/decrease according to a detected temperature of the inside of the hot-water supply apparatus and drives the air supply means. Furthermore, the anti-freezing program of the present invention may also be constituted so that this anti-freezing program further includes a step that obtains a temperature data of a space in which the hot-water supply apparatus is installed, the temperature data being detected by a temperature detection means, and a step that drives an air supply means, which streams air of the space to the primary heat exchanger and the secondary heat exchanger, in case where a temperature of the space is higher than the freezing prevention temperature.

In order to attain the above objects, an anti-freezing program of a hot-water supply apparatus according to the present invention is an anti-freezing program of a hot-water supply apparatus having a primary heat exchanger, which absorbs sensible heat of combustion exhaust generated by combustion of fuel, and a secondary heat exchanger which absorbs latent heat of said combustion exhaust, and is a constitution which makes a computer execute the following steps. This anti-freezing program includes a step that obtains a first temperature data of a water pipe of an entrance water side, a step that obtains a second temperature data of a water pipe of an outgoing hot-water side, a step that makes a comparison between the first and second temperatures and a freezing prevention temperature which forms reference of a start of freezing prevention operation, a step that drives a combustion means for a settled time for the purpose of heating the primary heat exchanger in case where either the first temperature or the second temperature reaches the freezing prevention temperature, or in case where both of them reach the freezing prevention temperature, and a step that drives an air supply means for the purpose of streaming air from a side of the primary heat exchanger to the secondary heat exchanger for a given time after a stop of drive of the combustion means.

As described above, the present invention relates to a hot-water supply apparatus which heats water to supply hot water, and utilizes the existing equipment and is designed to give the efficient prevention of freezing by using combustion with air supply. Therefore, the present invention is useful invention on an industry.

Furthermore, enumerating the featured matters and advantages of the present invention, these are as in the following.

(1) The prevention of freezing of the hot-water supply apparatus can be given without relating to a place of installation of the hot-water supply apparatus, namely without relating to the inside of a house or the outside of a house, and it is possible to maintain a hot-water supply function with high reliability.

(2) Since air supply operation can be performed at a time interval according to a temperature of the heat exchanger, it is possible to efficiently prevent freezing.

(3) It is possible to make the hot-water supply apparatus shift to the freezing prevention operation without relating to ON/OFF of an operating switch.

(4) Since the prevention of freezing corresponding to the number of heat exchangers to be installed and a capacity of a heat exchangers can be performed, there is not to be attended with the increase of an electric heating capacity such as prevention of freezing by electric heating, and the present invention is efficient.

(5) It is possible to perform the prevention of freezing by utilizing the existing equipment, and the present invention is economical.

BRIEF DESCRIPTION OF THE DRAWINGS

The foregoing and other objects, features and attendant advantages of the present invention will be appreciated as the same become better understood by means of the following description and accompanying drawings wherein.

DETAILED DESCRIPTION OF THE PREFERRED EMBODIMENTS

Figure 1:
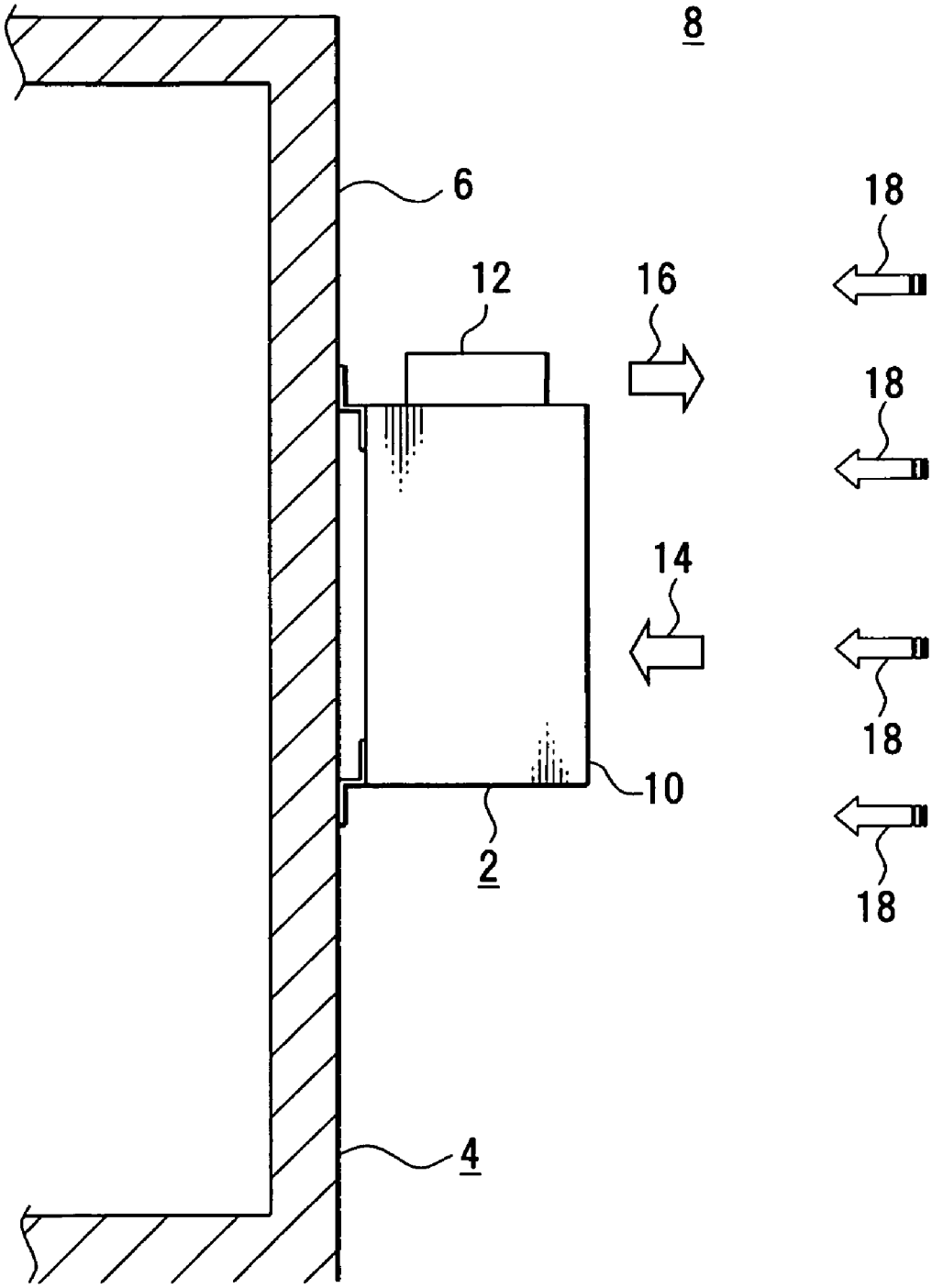
FIG. 1 is a drawing showing an example of outdoor installation of a hot-water supply apparatus according to an embodiment of the present invention.
Figure 2:
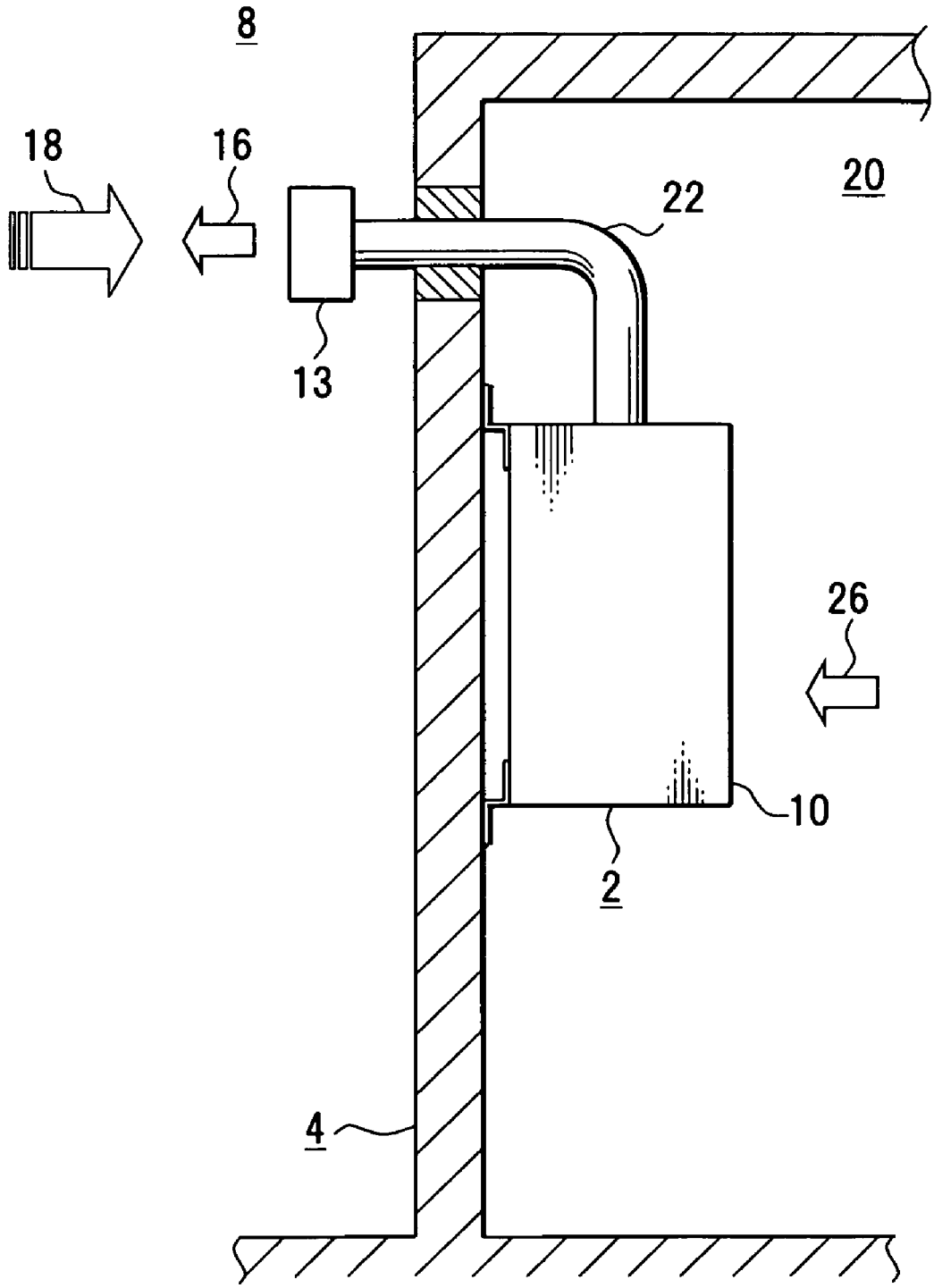
FIG. 2 is a drawing showing an example of indoor installation of the hot-water supply apparatus according to the embodiment of the present invention.

The form of installation of a hot-water supply apparatus which is an embodiment of the present invention is explained by referring to FIG. 1 and FIG. 2. FIG. 1 shows the hot-water supply apparatus installed in the outside of a house, and FIG. 2 shows the hot-water supply apparatus installed in the inside of a house.

As shown in FIG. 1, a hot-water supply apparatus 2 is attached to an outside wall 6 of a house 4, and is installed in an outside 8 of the house 4 to be used. This hot-water supply apparatus 2 has a housing 10 and an exhaust top 12. There is an air supply function taking in ambient air 14 in a side of the housing 10, and a side of the exhaust top 12 has an exhaust function exhausting combustion exhaust 16. That is, the hot-water supply apparatus 2 sucks in air for combustion from the ambient air 14, and the combustion exhaust 16 is exhausted from the exhaust top 12. In this case, cold air 18 is sucked into the hot-water supply apparatus 2 from its front side. This hot-water supply apparatus 2, for example, is forwarded as a product for indoor use, and the exhaust top 12 for outdoor use is to be installed as an additional component.

On the other hand, in case of installing this hot-water supply apparatus 2 in an inside 20 of the house 4, as shown in FIG. 2, an exhaust pipe 22 is attached to the housing 10 which is attached to an inside wall of the house 4. The exhaust pipe 22 is made to penetrate the house 4 and is extended to the outside 8 of the house 4, and an exhaust top 13 for outdoor use is provided at a pointed end portion of the exhaust pipe 22. The combustion exhaust 16 of the hot-water supply apparatus 2 is ejected to the outside 8 of the house 4 through the exhaust pipe 22 and the exhaust top 13. At this time, air 26 for combustion use is sucked into a side of the housing 10 from an inside 20 of the house 4. In the hot water supply apparatus 2 of indoor installation like this, the cold air 18 of the outside 8 of the house 4 invades a side of the exhaust pipe 22 through the exhaust top 13 by an adverse wind, and an inside of the hot-water supply apparatus 2 is cooled.

Figure 3:
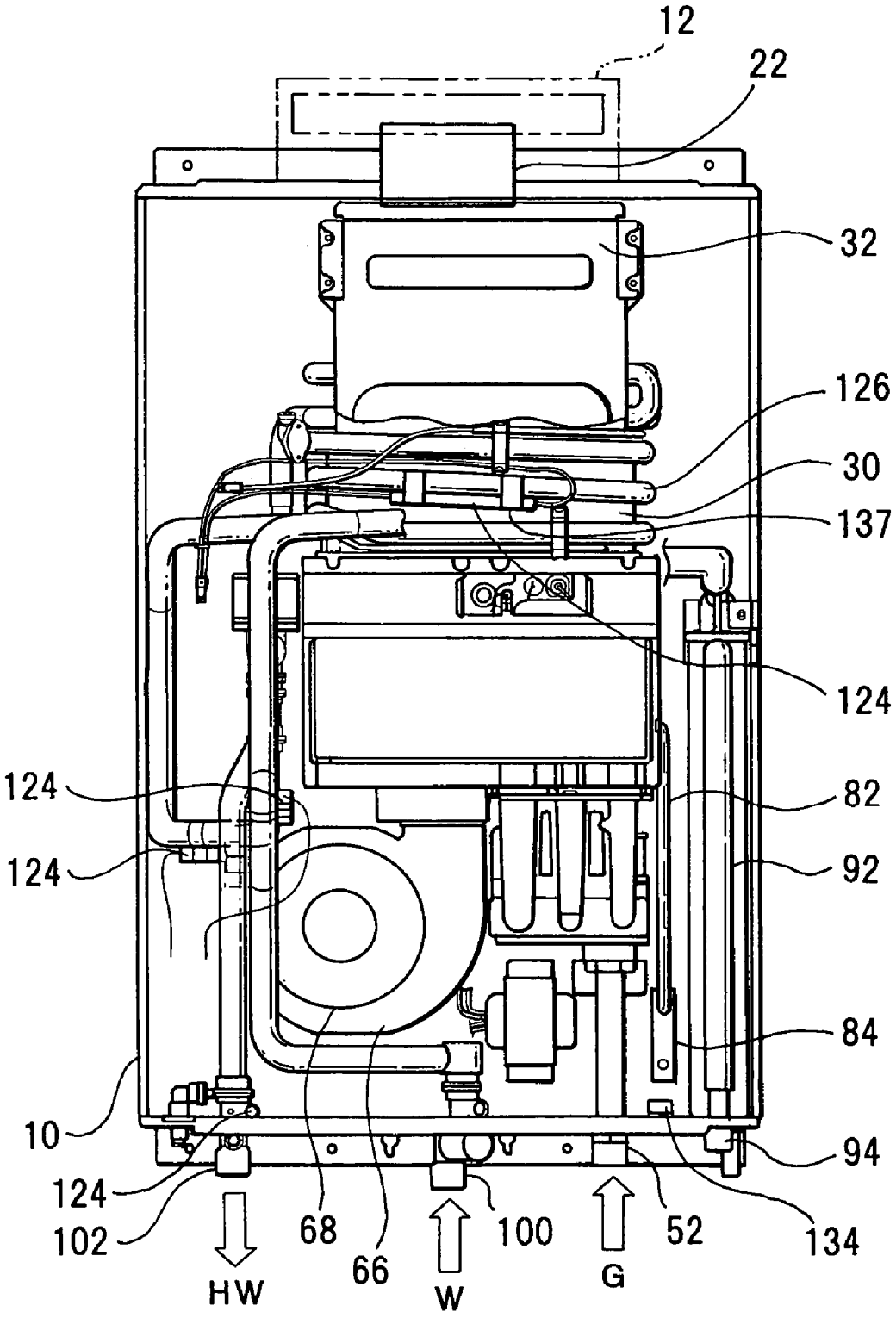
FIG. 3 is a drawing showing an inside constitution of the hot-water supply apparatus in the case of looking from the front.
Figure 4:
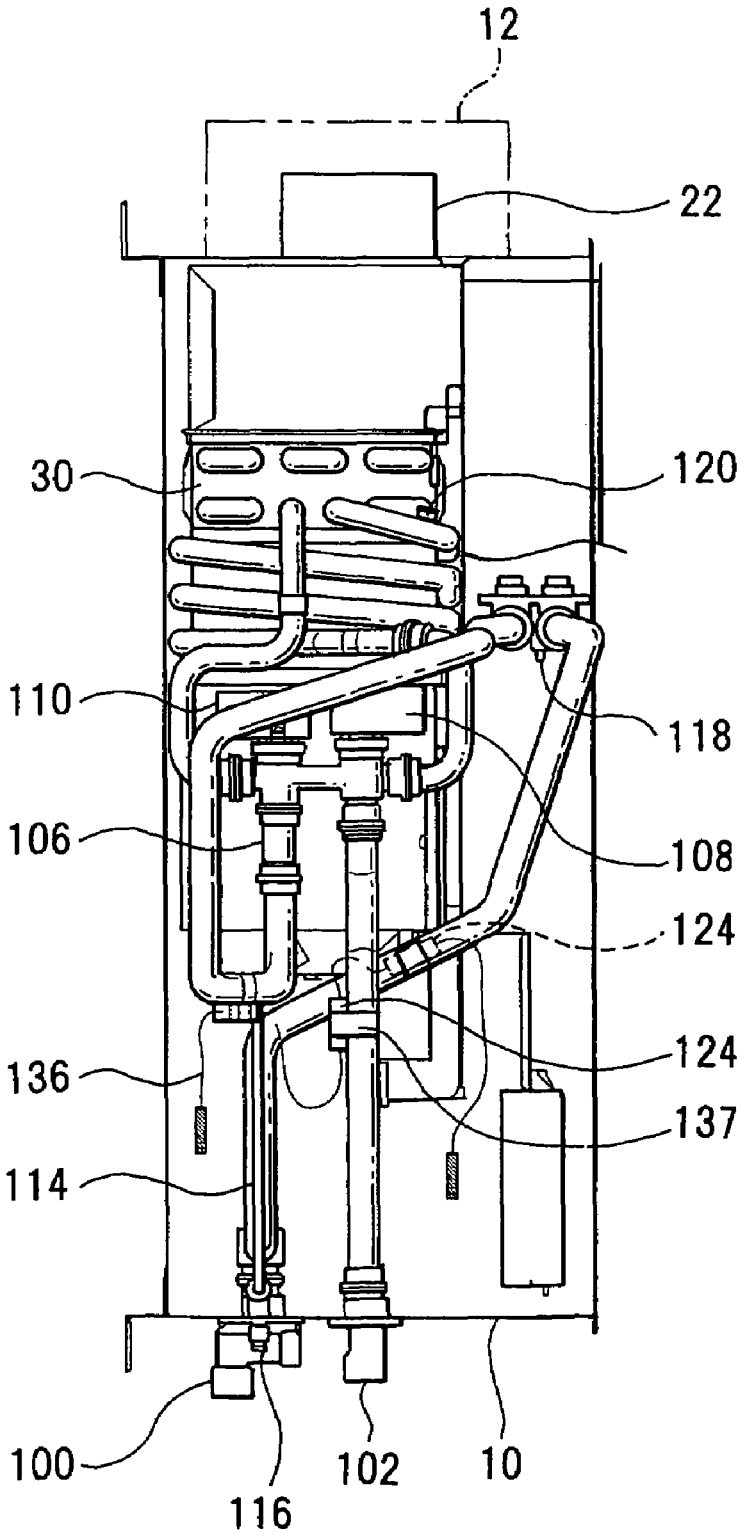
FIG. 4 is a drawing showing the inside constitution of the hot-water supply apparatus in the case of looking from the lateral side.
Figure 5:
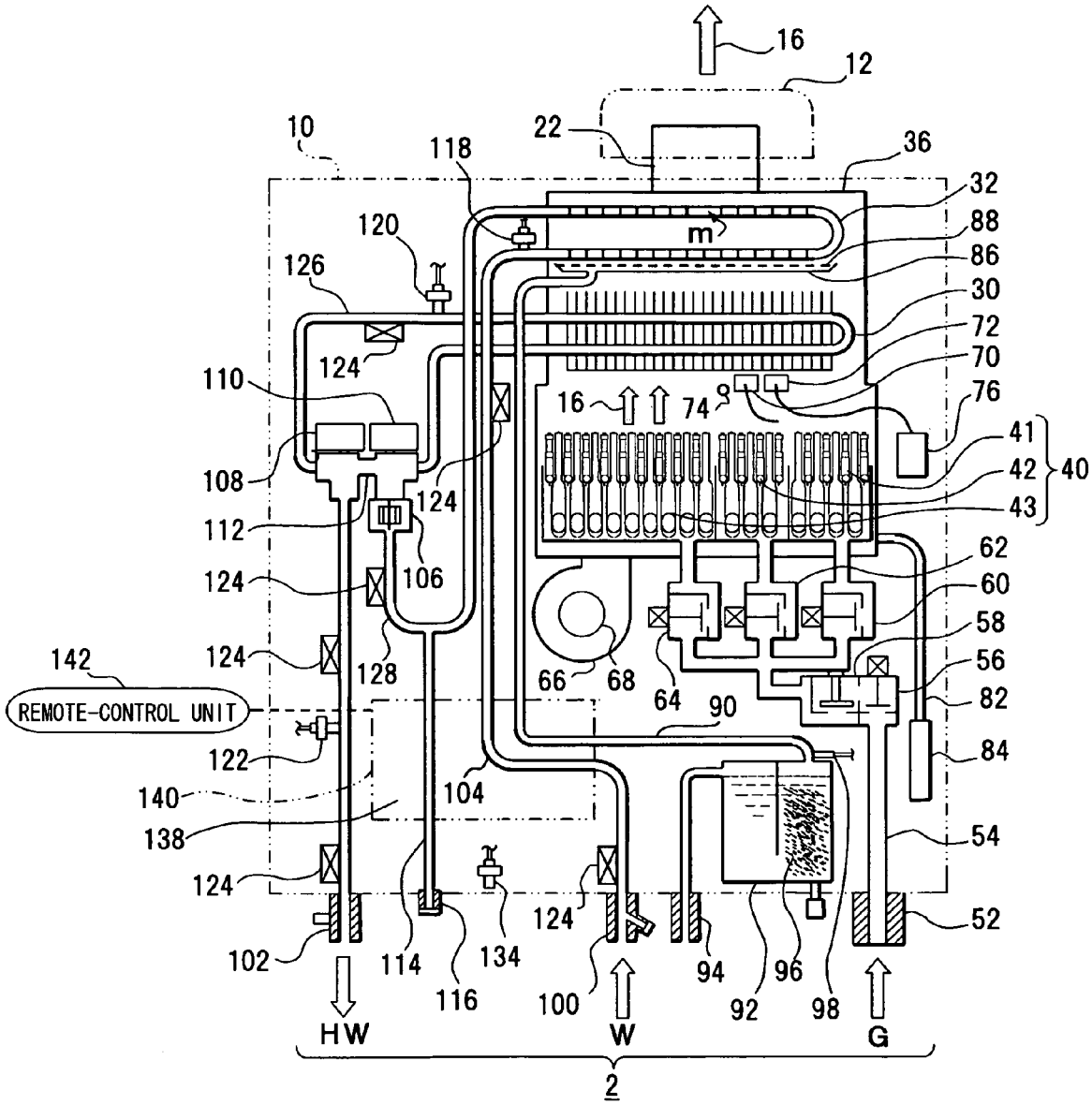
FIG. 5 is a drawing showing an example of a constitution of the hot-water supply apparatus.

Next, this hot-water supply apparatus is explained by referring to FIG. 3, FIG. 4 and FIG. 5. FIG. 3 is a drawing showing an inside constitution in the case of looking at the hot-water supply apparatus from its front side, FIG. 4 is a drawing showing an inside constitution in the case of looking at the hot-water supply apparatus from its lateral side, and FIG. 5 is a drawing showing an example of a constitution of the hot-water supply apparatus.

This hot-water supply apparatus 2 constitutes what is called a high-efficiency hot-water supply apparatus, and has a primary heat exchanger 30 and a secondary heat exchanger 32. In a combustion chamber 36 which is provided in the inside of the housing 10, a burner group 40 which consist of a plurality of burners is provided. In this embodiment, the burner group 40 is constituted by the three sets of burners 41, 42 and 43. The primary heat exchanger 30 is provided at an upstream side of the combustion exhaust 16 which is generated by combustion of this burner group 40, and the secondary heat exchanger 32 is provided at a downstream side thereof. Sensible heat is absorbed from the combustion exhaust 16 by the primary heat exchanger 30, and latent heat is absorbed from the combustion exhaust 16 passing through the primary heat exchanger 30 by the secondary heat exchanger 32. In addition, in the secondary heat exchanger 32, a reference letter "m" shows a portion which is cooled most by cold air.

A gas supply port 52 which is attached to the housing 10 is connected to a fuel gas supply source not shown in the drawings, and a fuel gas G is distributed and is supplied to each of the burners 41 through 43 through a gas supply pipe 54. At a portion between the gas supply pipe 54 and each of the burners 41 through 43, a stop valve 56 and a proportional valve 58 are provided in common, and capability switching valves 60, 62 and 64 which switch supply of the fuel gas G are also provided at each of the burners 41 through 43.

An air supply fan 66 is provided at a lower face side of the combustion chamber 36, and the air for combustion use is sent to the combustion chamber 36. The air supply fan 66 is rotated by a fan motor 68. At an upper side of the burner group 40, a flame rod 70 and an ignition plug 72 are provided, and an abnormal combustion detector 74 is also provided. To the ignition plug 72, an igniter 76 giving an ignition current is connected.

The exhaust pipe 22 for the purpose of discharging the combustion exhaust 16 into the open air is attached to an upper portion of the combustion chamber 36, and the exhaust top 12 is attached to this exhaust pipe 22. In order to detect the wind pressure of air which invades the combustion chamber 36 from the exhaust top 12 by a counter flow, a wind pressure sensor 84 is connected to the combustion chamber 36 through a detection pipe 82, and a detected wind pressure is taken out as an electric signal.

Further, a drain receiver 86 is installed in the secondary heat exchanger 32. After a drain 88 generated at the secondary heat exchanger 32 by heat exchange is accumulated in the this drain receiver 86, the drain 88 is guided to a neutralization unit 92 through a drain pipe 90, and the drain 88 which is neutralized is discharged outside the housing 10 from a drain outlet 94. In the neutralization unit 92, a neutralization agent 96 which neutralizes strong acidity of the drain 88 is filled up. A drain sensor 98 is provided at a drain introducing portion of the neutralization unit 92, the drain 88 flowing backward is detected, and a detected signal representative thereof is taken out.

Further, in the housing 10, a water inlet 100 for the purpose of supplying tap water W and a hot-water outlet 102 for the purpose of taking out hot water HW are provided. A water pipe 104 which forms a water pipe passage is provided between the water inlet 100 and the hot-water outlet 102. In this water pipe 104, the secondary heat exchanger 32, a quantity-of-water sensor 106, the primary heat exchanger 30, a water control valve 108 and so on are installed, and a by-pass valve 110 and a by-pass pipe 112 are also installed astride the primary heat exchanger 30. A water drain pipe 114 which branches from the water pipe 104 is led to a wall part of the housing 10, and is blockaded by a water drain stop cock 116. Further, in the water pipe 104, a temperature sensor 118 which detects an entrance water temperature, a temperature sensor 120 which detects an outgoing hot-water temperature and a temperature sensor 122 which detects a mixed hot-water temperature are provided, and a plurality of heaters 124 are also installed. These heaters 124 are a means which heats the water pipe 104, a drum pipe 126 of the primary heat exchanger 30 and a pipe 128 of the secondary heat exchanger 32 in order to prevent freezing. Each of the heaters 124 is provided at a position adjacent to the water inlet 100, at a position of an entrance side of the secondary heat exchanger 32, at a position of an exit side of the primary heat exchanger 30, at an intermediate position between the water control valve 108 and the hot-water outlet 102, at a position adjacent to the hot-water outlet 102, at the drum pipe 126 of the primary heat exchanger 30 and at the pipe 128 of the secondary heat exchanger 32 by heater fixing plates 137. To each of the heaters 124, power is supplied through a temperature-sensitive switch 134 which is conducted by a detected temperature of the inside of the housing 10. A reference numeral 136 is a lead wire.

Furthermore, in the housing 10, a control unit 138 which receives detected signals of various kinds of sensors to control opening/closing of each valve as an example is installed. This control unit 138 is constituted by an electronic equipment board 140 and so on. In addition, a remote-control unit 142 is connected to the control unit 138, and it is possible to operate the control unit 138 from an outside by the remote-control unit 142.

Figure 6:
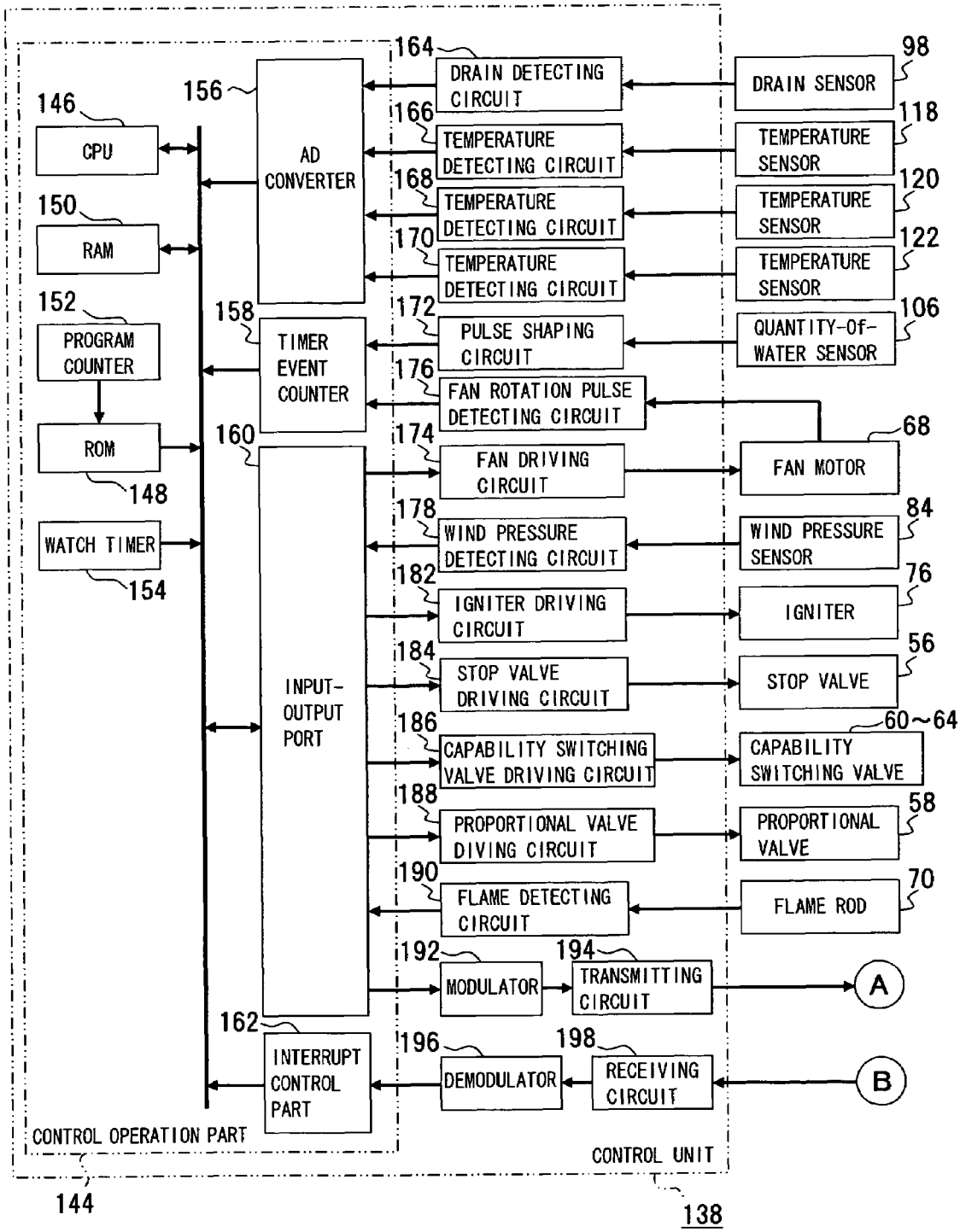
FIG. 6 is a block diagram showing a control unit.

Next, the control unit 138 is explained by referring to FIG. 6. FIG. 6 shows an example of the control unit 138.

In the control unit 138, a control operation part 144 which is constituted by a computer is installed. In this control operation part 144, a CPU (Central Processing Unit) 146, a ROM (Read-Only Memory) 148, a RAM (Random-Access Memory) 150, a program counter 152, a watch timer 154, an analog-to-digital (AD) converter 156, a timer event counter 158, an input-output port 160 and an interrupt control part 162 are provided. According to this control unit 138, control, such as hot-water supply control and freezing prevention control, is executed. The freezing prevention control is executed correspondingly to the form of installation of the hot-water supply apparatus 2, namely the outdoor installation and the indoor installation. Therefore, based on a hot-water supply control program and a freezing prevention control program which are stored in the ROM 148, the CPU 146 executes operational control using input information from various kinds of sensors, and generates control outputs. In the ROM 148, fixed values and so on necessary for operation are stored in addition to the hot-water supply control program and the freezing prevention control program. The program counter 152 designates an address of a program, which is executed, toward the ROM 148. The RAM 150 stores a data in the middle of operation, a detected data and so on. The watch timer 154 is a watch dog timer, and is constituted by a presettable counter with an overflow. The watch timer 154 generates an output representative of abnormality in case in which the execution of a program does not complete at a settled time. The AD converter 156 converts an input data, which is an analog data such as a detected signal, into a digital data. The timer event counter 158 is used for the detection of a rotating speed of the fan motor 68. The input-output port 160 is used for the taking-out of an input-output data. Further, the interrupt control part 162 is used for interrupt control due to control inputs from the remote-control unit 142.

Further, this control unit 138 has the following. A drain detecting circuit 164 is provided correspondingly to the drain sensor 98, temperature detecting circuits 166, 168 and 170 are provided correspondingly to the temperature sensors 118 through 122, and a pulse shaping circuit 172 is provided correspondingly to the quantity-of-water sensor 106. A fan driving circuit 174 and a fan rotation pulse detecting circuit 176 are provided correspondingly to the fan motor 68, a wind pressure detecting circuit 178 is provided correspondingly to the wind pressure sensor 84, and an igniter driving circuit 182 is provided correspondingly to the igniter 76. A stop valve driving circuit 184 is provided correspondingly to the stop valve 56, a capability switching valve driving circuit 186 is provided correspondingly to the capability switching valves 60 through 64, a proportional valve driving circuit 188 is provided correspondingly to the proportional valve 58, and a flame detecting circuit 190 is provided correspondingly to the flame rod 70. Further, a modulator 192, a transmitting circuit 194, a demodulator 196 and a receiving circuit 198 are provided correspondingly to the remote-control unit 142 in order to perform processing of transmission-reception, modulation and demodulation of a control data.

Figure 7:
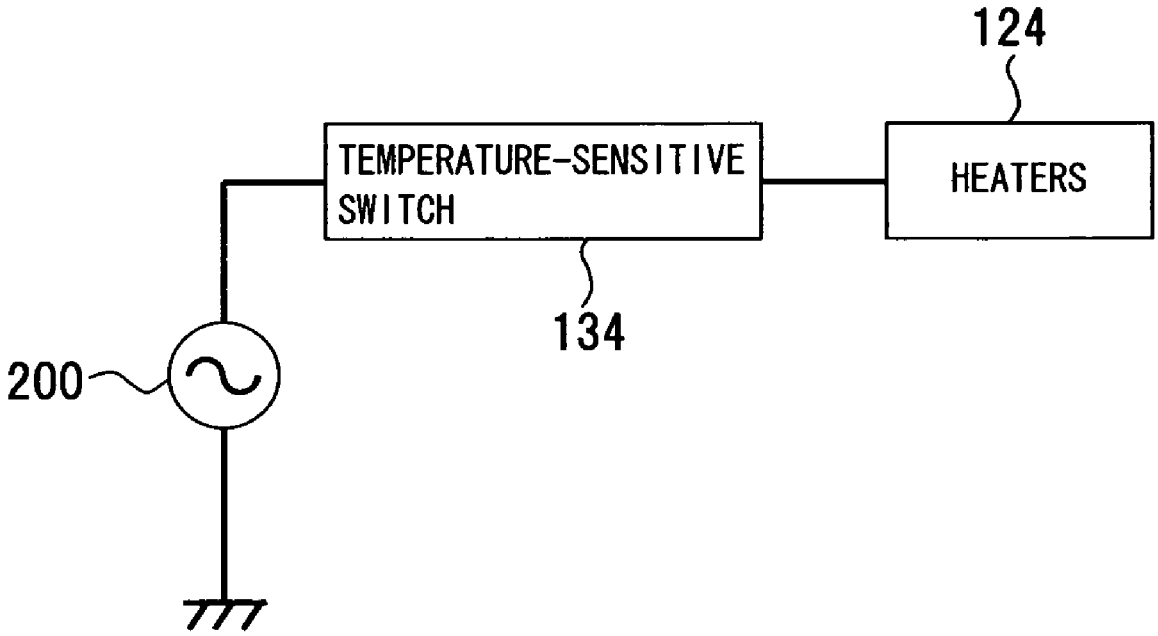
FIG. 7 is a drawing showing an example of a constitution of an electric heating unit.

As shown in FIG. 7, for example, an alternating-current power source 200 is supplied to the heaters 124 through the temperature-sensitive switch 134, and ON/OFF of power supply is performed by switching based on the sensing of a temperature of the temperature-sensitive switch 134.

Figure 8:
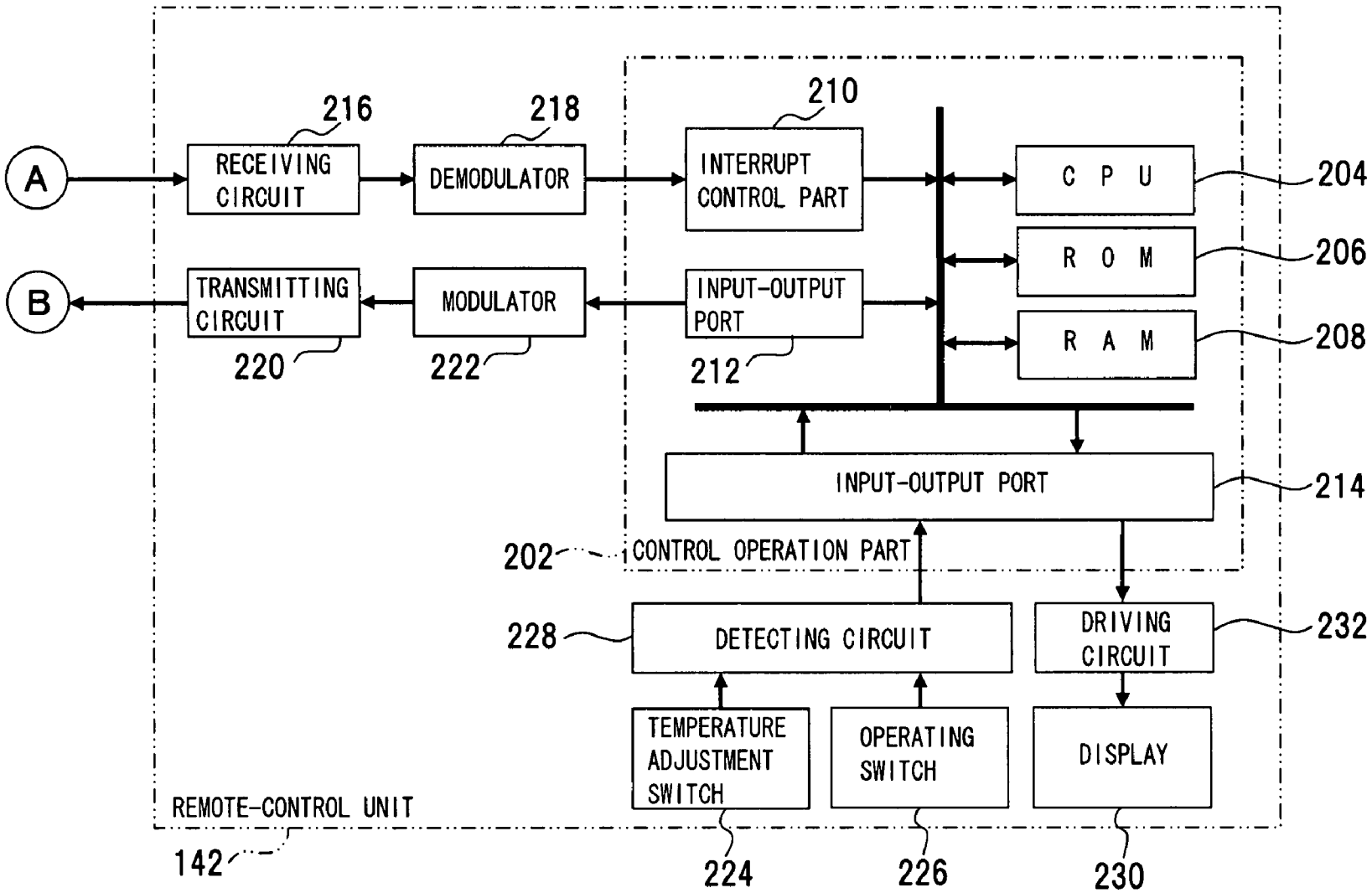
FIG. 8 is a block diagram showing an example of a constitution of a remote-control unit.

Next, the remote-control unit 142 is explained by referring to FIG. 8. FIG. 8 shows an example of the remote-control unit 142.

This remote-control unit 142 has a control operation part 202 which is constituted by a computer. In this control operation part 202, a CPU 204, a ROM 206, a RAM 208, an interrupt control part 210 and input-output ports 212 and 214 are installed. In order to receive a data from the control unit 138, a receiving circuit 216 and a demodulator 218 are provided, and, in order to transmit a control data to the control unit 138, a transmitting circuit 220 and a modulator 222 are provided. Further, a temperature adjustment switch 224 for the adjustment of a temperature and an operating switch 226 are provided, and a detecting circuit 228 is provided correspondingly to these switches. Furthermore, a display 230 and a driving circuit 232 for the purpose of displaying information are provided.

Next, a fundamental operation of hot-water supply is explained.

If the hot-water supply apparatus 2 is placed under an operating state and the water W flows through the water pipe 104 from the water inlet 100, the burners 41 through 43 are ignited, and the fuel gas G is burned by the burners 41 through 43. The combustion exhaust 16 of these burners 41 through 43 passes through the primary heat exchanger 30 and the secondary heat exchanger 32, and flows to the exhaust pipe 22 and the exhaust top 12 from the combustion chamber 36. The water W passes through the secondary heat exchanger 32, and is heated by latent heat of the combustion exhaust 16. After that, the water W is heated at the primary heat exchanger 30 by sensible heat of the combustion exhaust 16, and flows into the hot-water outlet 102 through the water control valve 108. In this case, hot water of a low temperature which is heated by the secondary heat exchanger 32 is mixed in hot water HW heated by the primary heat exchanger 30 from the by-pass pipe 112 through the by-pass valve 110, and the hot water HW with a suitable temperature is given from the hot-water outlet 102.

Next, a fundamental operation of freezing prevention is explained.

Firstly, explaining on the setting of freezing prevention combustion and fan-motor rotation, in combustion control the minimum combustion of an all-combustion state is set to a fixed time for four (4) seconds as a predetermined time, for example. Here, in the all-combustion state the minimum combustion means that all of the burners 41 through 43 of the burner group 40 are in combustion state and that the combustion state thereof is burned by minimum gas volume. Hereafter, this combustion state is represented as "all-combustion minimum combustion".

For example, if the all-combustion minimum combustion is set to a period of three (3) seconds, the effect of freezing prevention is thin. For example, if the all-combustion minimum combustion is set to a period of five (5) seconds, it is feared that partial boiling may occur. Although in our experiment abnormality such as partial boiling is not observed, a temperature of a bend portion (a bend temperature) which reaches the highest temperature at the time of combustion is about 60° C.

In the outdoor installation, when the temperature sensor 120 detects a temperature below 8° C. as an example and the temperature sensor 118 detects a temperature below 3° C. as an example, the freezing prevention combustion is performed. In case in which in the outdoor installation an adverse wind occurs, an atmosphere of the inside of the housing 10 is a temperature below the freezing point, and the secondary heat exchanger 32 is cooled by the adverse wind. Because of this, a fall in a detected temperature of the temperature sensor 118 becomes conspicuous. Further, since there is some fear that partial boiling may occur if the freezing prevention combustion is performed under a state that a temperature of the primary heat exchanger 30 is high, a threshold value is set as a starting temperature of freezing prevention combustion by a detected temperature (=a temperature of the primary heat exchanger 30) of the temperature sensor 120.

On the other hand, in the indoor installation, when the temperature sensor 120 detects a temperature below 3° C. as an example, the freezing prevention combustion is started. In case in which in the indoor installation an adverse wind occurs, a fall in a detected temperature of the temperature sensor 120 (=a temperature of the primary heat exchanger 30) becomes conspicuous. Here, since the temperature sensor 118 receives strongly the influence of an indoor temperature, the influence of a fall in a temperature (a fall in a temperature of the secondary heat exchanger 32) due to the adverse wind is small.

Next, in control after the combustion, a combustion interval is set to a predetermined time, for example, a period of three hundred (300) seconds (=five (5) minutes). In order to prevent the occurrence of hunting in which combustion and a stop of the combustion of the freezing prevention combustion is repeated, the combustion interval is set. This interval time is set to a time period which does not cause a problem at the time of an adverse wind of 15 m/sec under a state −30° C. in the outdoor installation.

A post-purge time is not fixed but is varied by using a detected temperature of the temperature sensor 120. Therefore, for example, this time is a time between thirty (30) seconds and three hundred (300) seconds, and, when the temperature sensor 120 detects a temperature below 15° C. as an example, the combustion is stopped. The post-purge time is a fan-motor rotating time after the freezing prevention combustion.

Heat of the primary heat exchanger 30 which is heated by the freezing prevention combustion is distributed to the secondary heat exchanger 32 by a post-purge. This distribution is the reason why an effect of temperature rising of the secondary heat exchanger 32 by the freezing prevention combustion is low. If an surrounding temperature (a room temperature) of the housing 10 is high in case in which the hot-water supply apparatus 2 is installed in the inside 20 of the house 4, air in the room is sent to the primary heat exchanger 30 and the secondary heat exchanger 32 by the air supply fan 66 driven by rotating the fan motor 68. By this, the primary heat exchanger 30 and the secondary heat exchanger 32 which are cooled by a cold wind are heated. In addition, in order not to cool the primary heat exchanger 30 by the post-purge more than necessary, a limit time of the post-purge is set based on a detected temperature of the temperature sensor 120.

(1) A case in which the hot-water supply apparatus 2 is installed in the outside of a house (FIG. 1)

In case in which the hot-water supply apparatus 2 is installed in the outside 8 of the house 4, both of the heat by the heaters 124 and the heat by means of the freezing prevention combustion function as a freezing prevention means. When a detected temperature of the temperature sensor 118 which is easy to receive the influence of cold air comes to a temperature below a threshold value, for example, below 3° C., the operation of the freezing prevention combustion is started.

Although the heaters 124 and the freezing prevention combustion for the purpose of preventing freezing are operated individually, both of them may also be made to link by using a sensor in common.

Figure 9:
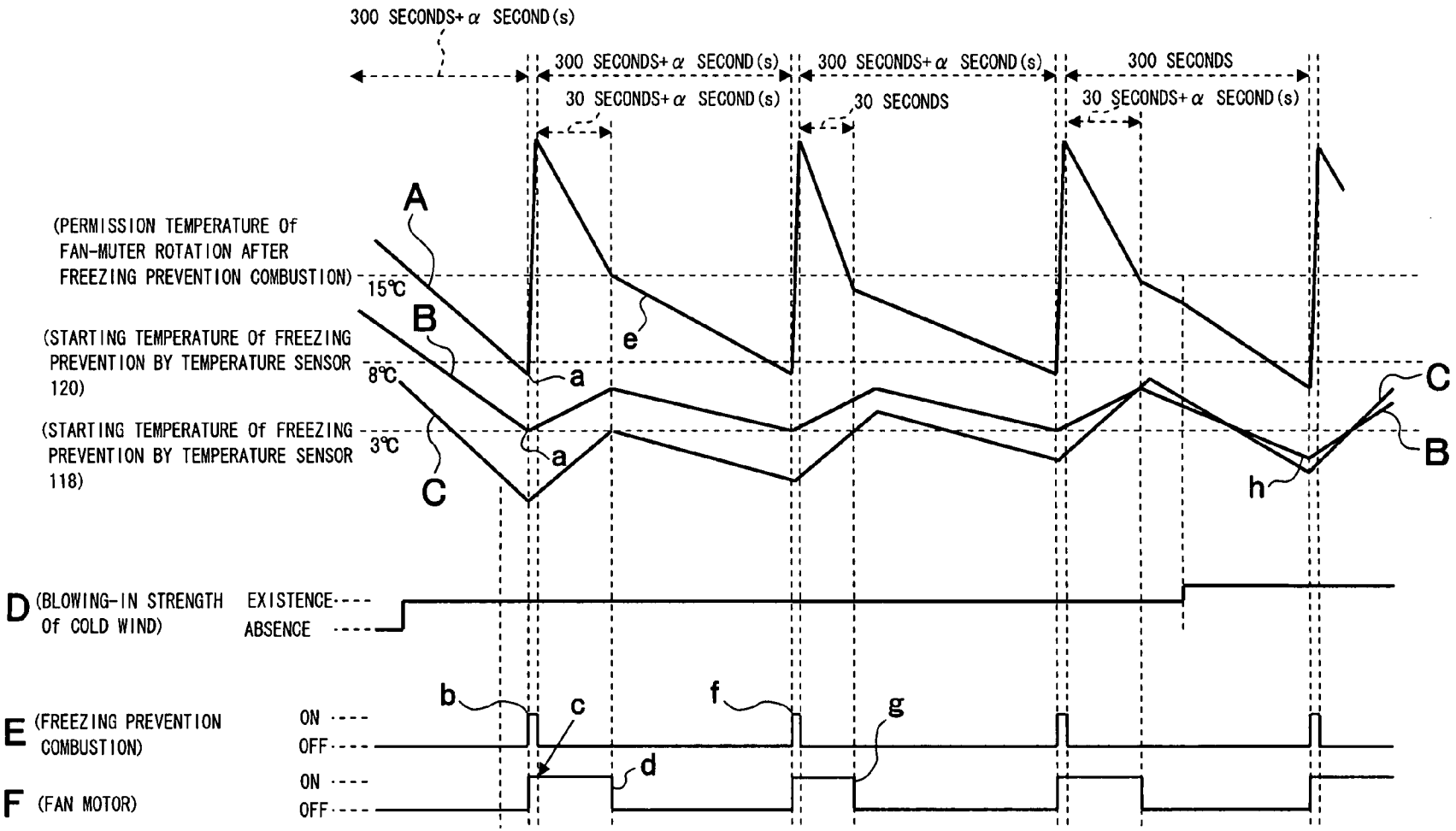
FIG. 9 is a drawing showing freezing prevention operation of the hot-water supply apparatus of the outdoor installation.

The state of operation in case of installing the hot-water supply apparatus 2 in the outside of a house is explained by referring to FIG. 9. FIG. 9 is the state of operation in case in which combustion is started under a state that a detected temperature of the temperature sensor 118 is below 3° C. and a detected temperature of the temperature sensor 120 is below 8° C. In FIG. 9, a reference letter "A" is the transition of a detected temperature of the temperature sensor 120, a reference letter "B" is the transition of a detected temperature of the temperature sensor 118, a reference letter "C" is the transition of a temperature of the secondary heat exchanger 32 (a detected temperature of the portion m described before), a reference letter "D" is the blowing-in strength of a cold wind, a reference letter "E" is the operation of the freezing prevention combustion, and a reference letter "F" is the operation of the fan motor. The detected temperature of the portion m of the secondary heat exchanger 32 is a temperature which is detected for the purpose of confirming a freezing prevention function by providing a temperature sensor. In the reference letters "E" and "F", "ON" shows an operation, and "OFF" shows a stop of the operation. In FIG. 9, reference letters "a" through "h" are as in the following.

a: The detection of the starting temperature of freezing prevention of the temperature sensors 118 and 120

A water temperature of an inside of a water pipe is detected by the temperature sensors 118 and 120, and it is detected that the water temperature falls to the starting temperature of freezing prevention.

b: The start of the freezing prevention combustion

In order to efficiently heat the primary heat exchanger 30 and the secondary heat exchanger 32, the freezing prevention combustion is performed by the all-combustion minimum combustion. A combustion time is a fixed time of a period of four (4) seconds, for example.

c: The start of fan-motor rotation (the post-purge) after the freezing prevention combustion Since it is impossible to heat the secondary heat exchanger 32 by performing only the freezing prevention combustion, remaining heat of the primary heat exchanger 30 which is heated by the freezing prevention combustion is distributed to the secondary heat exchanger 32 by the rotation of the fan motor 68, and the secondary heat exchanger 32 is heated.

d: The fan-motor rotating (the post-purge) time after the freezing prevention combustion The rotating time of the fan motor 68 is a variable time value from a minimum of thirty (30) seconds to a maximum of three hundred (300) seconds as a range of a predetermined time, for example. The rotation of the fan motor 68 (the post-purge) is performed for thirty (30) seconds as an example of the predetermined time after the freezing prevention combustion. After this, the fan motor 68 is made to rotate on a condition that a detected temperature of the temperature sensor 120 is above 15° C. as an example of the threshold temperature until three hundred (300) seconds as an example of the predetermined time pass. As a result of this control, in case in which the primary heat exchanger 30 has a temperature to spare, its remaining heat is sent to the secondary heat exchanger 32. Because of this, the freezing prevention in which the balance of heat-exchanger temperatures is good is performed. "30 seconds+$\alpha$ second(s)" and "300 seconds+$\alpha$ second(s)" in the drawings shows that a time period is a variable time period.

e: After the fan-motor rotation (the post-purge)

If the heat distribution to the secondary heat exchanger 32 by the rotation of the fan motor 68 is finished, a temperature gradient becomes small because a cause of the fall in a temperature of the primary heat exchanger 30 is only the cold air.

f: The start of the freezing prevention combustion

Since three hundred (300) seconds as an example of the predetermined time of the interval time is exceeded and a detected temperature of the temperature sensor 118 reaches the threshold temperature which is the starting temperature of the freezing prevention, the freezing prevention combustion is started again.

g: The rotation of the fan motor after the freezing prevention combustion

Since a detected temperature of the temperature sensor 120 is below 15° C. as an example of the threshold temperature after the lapse of thirty (30) seconds as an example of a minimum limit time of the rotating time of the fan motor 68, the rotation of the fan motor 68 is stopped.

h: In case in which the interval time does not exceed three hundred (300) seconds even if a detected temperature of the temperature sensor 118 reaches the threshold value, the freezing prevention combustion is not performed.

(2) A case in which the hot-water supply apparatus 2 is installed in the inside of a house (FIG. 2)

In case in which the hot-water supply apparatus 2 is installed in the inside 20 of the house 4, the freezing prevention means is mainly the heaters 124. When cold air enters from the exhaust top 12, the freezing precaution combustion is started. At this time, a start of the freezing prevention combustion is a detected temperature of the temperature sensor 120. Since a detected temperature of the temperature sensor 118 receives strongly the influence of a room temperature rather than cold air, it can not be used for a starting condition of the freezing prevention combustion.

Figure 10:
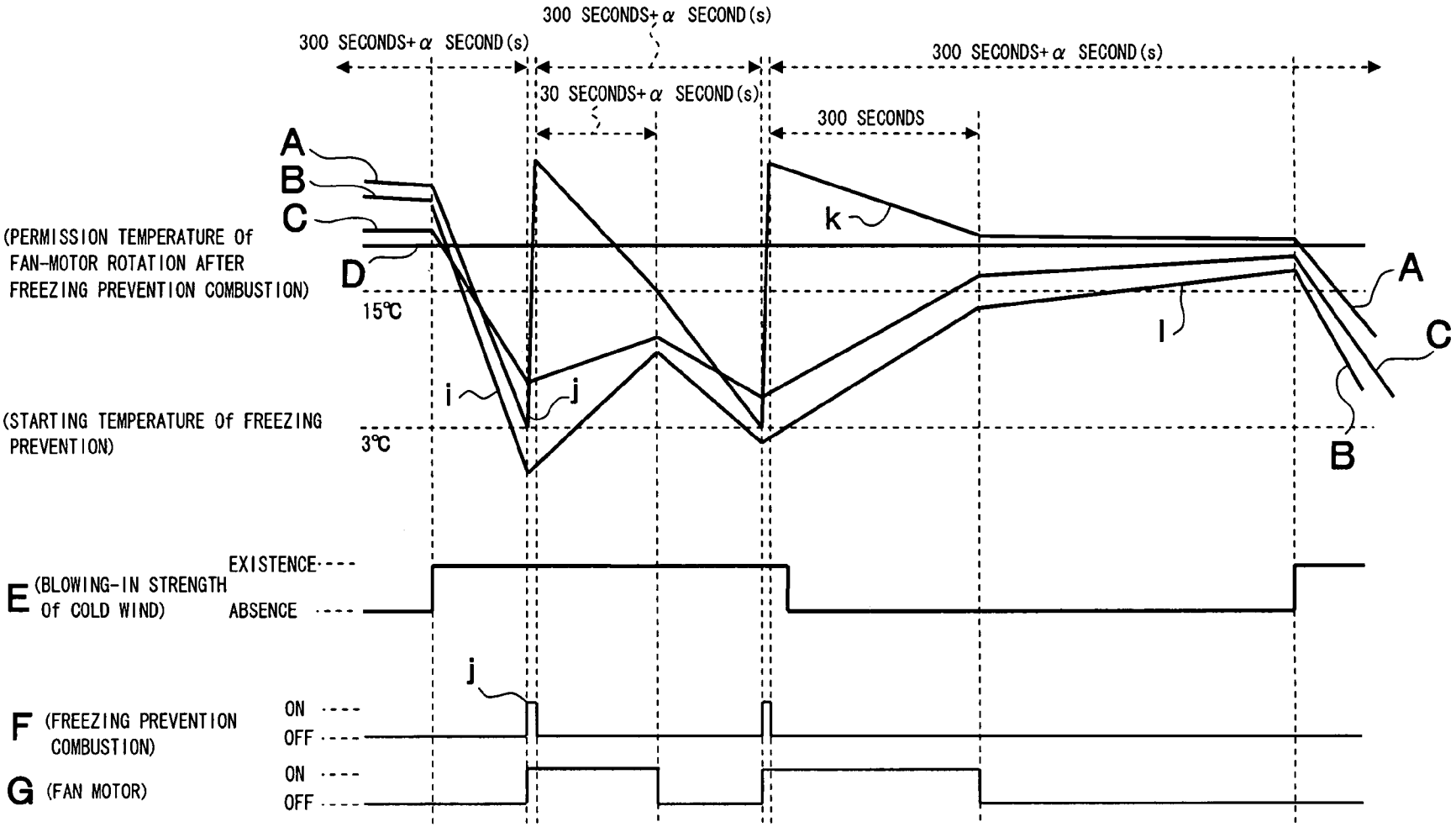
FIG. 10 is a drawing showing freezing prevention operation of the hot-water supply apparatus of the indoor installation.

Therefore, the state of operation in case of installing the hot-water supply apparatus 2 in the inside 20 of a house is explained by referring to FIG. 10. FIG. 10 is the state of operation in case in which combustion is started under a state that a detected temperature of the temperature sensor 120 is below 3° C. In FIG. 10, a reference letter "A" is the transition of a detected temperature of the temperature sensor 120, a reference letter "B" is the transition of a temperature of the secondary heat exchanger 32 (a detected temperature of the portion m described before), a reference letter "C" is the transition of a detected temperature of the temperature sensor 118, a reference letter "D" is an ambient temperature of the housing 10, a reference letter "E" is the blowing-in of a cold wind, a reference letter "F" is the operation of the freezing prevention combustion, and a reference letter "G" is the operation of the fan motor. In the reference letters "F" and "G", "ON" shows an operation, and "OFF" shows a stop of the operation. In FIG. 10, reference letters "i" through "1" are as in the following.

i: Entering of a cold wind from the exhaust top 12

In case in which the hot-water supply apparatus 2 is installed in the inside 20 of the house 4, a temperature of the secondary heat exchanger 32 falls by a cold wind blown in from the exhaust top 12. However, since a temperature of the inside of the housing 10 of the hot-water supply apparatus 2 receives the influence of a room temperature, the transition of the detected temperatures of the temperature sensors 118 and 120 is to be different from the case of the hot-water supply apparatus 2 of the outdoor installation. Therefore, if the control of the freezing prevention combustion is performed by using the detected temperature of the temperature sensor 120, which can strongly receive the influence of cold air, for control information, the freezing prevention function is heightened. A temperature of the inside of the housing 10 becomes high by the influence of the room temperature. Because of this, even if the hot-water supply apparatus 2 reaches the freezing prevention temperature, there are cases in which it is impossible to heat by the heaters 124 because the temperature-sensitive switch 134 does not operate. However, the freezing prevention combustion can complement such an inconvenience, and the freezing prevention function is heightened. In this case, in case of surroundings near a temperature below the freezing point even the installation of the inside 20 of the house 4, the temperature-sensitive switch 134 operates and the heat operation by the heaters 124 is performed.

j: The freezing prevention combustion

The interval time is counted from an impression of the power source to the hot-water supply apparatus 2 or from after the previous freezing prevention combustion, and the freezing prevention combustion is performed when the interval time and the detected temperature of the temperature sensor 120 exceed the threshold values, k: The rotation of the fan motor 68 (the post-purge) after the freezing prevention combustion A time period of the rotation of the fan motor 68 (the post-purge) after the freezing prevention combustion is variable. In case in which a surrounding temperature of the housing 10 of the hot-water supply apparatus 2 (a room temperature) is high, it is possible to heat the primary heat exchanger 30 and the secondary heat exchanger 32 also by air of the room temperature. Because of this, after the lapse of thirty (30) seconds as an example of a predetermined time, the fan motor 68 is made to rotate until the detected temperature of the temperature sensor 120 becomes below 15° C. as an example or until the interval time exceeds a maximum of three hundred (300) seconds as an example.

1: A case in which the blowing-in of a cold wind is gone

In case in which the hot-water supply apparatus 2 is installed in the inside 20 of the house 4, the freezing prevention combustion works due to the blowing-in of a cold wind as an example. However, if the blowing-in of the cold wind is gone, the temperatures of the primary and secondary heat exchangers 30 and 32 rise to approach the room temperature.

Figure 11:
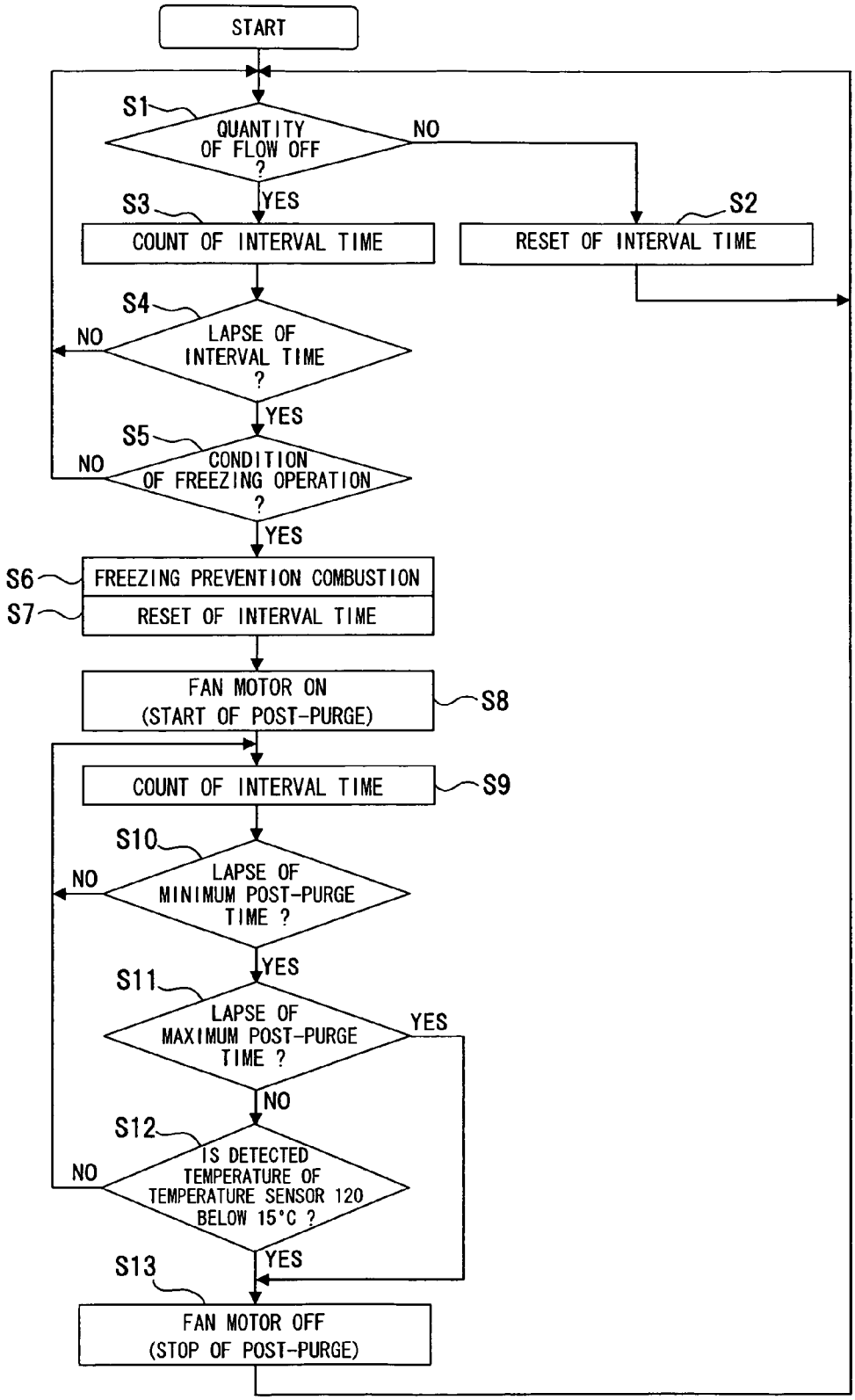
FIG. 11 is a flow diagram showing the procedure of processing of an anti-freezing method of a hot-water supply apparatus according to the embodiment of the hot-water supply apparatus.

Next, an embodiment of an anti-freezing method of the hot-water supply apparatus of the present invention is explained by referring to FIG. 11. FIG. 11 is a flow diagram showing the procedure of processing in a method and a program of the freezing prevention control.

In order to decide whether or not the hot-water supply apparatus 2 is in a state of normal hot-water supply, whether or not detected quantity of flow exists is decided by referring to a quantity-of-flow detection output of the quantity-of-water sensor 106 (a step S1). In case in which the detected quantity of flow exists, the interval time which is counted by the timer event counter 158 is reset (a step S2), and the freezing prevention control is returned to the step S1. If a quantity-of-flow detection signal is obtained from the quantity-of-flow sensor 106, the freezing prevention combustion control is ended because the hot-water supply apparatus 2 is in the state of the hot-water supply, and a shift to a normal combustion operation is performed. That is, under a stop state of the hot-water supply, a shift to the freezing prevention control is performed. A count of the interval time is performed on a condition that the detected quantity of flow does not exist (a step S3). As described before, this count is continued until the predetermined interval time passes under a state that the quantity of flow is OFF. Then, whether or not the interval time passes is decided (a step S4). The shift to the freezing prevention combustion is not performed until the interval time passes. By this, it is possible to prevent the repeated operation of combustion and a stop of the combustion, namely combustion hunting, and the stability of operation may be given.

After the interval time passes, whether or not a condition of the freezing prevention operation is given is decided (a step S5). That is, when a detected temperature of the temperature sensor 118 or the temperature sensor 120 shifts to a temperature below the starting temperature of the freezing prevention operation, the condition of freezing operation is formed, and the shift to the freezing prevention combustion is performed (a step S6). Concretely, when the temperature sensor 118 detects a temperature below 3° C. as an example of a predetermined temperature and the temperature sensor 120 also detects a temperature below 8° C. as an example of a predetermined temperature, the condition of freezing operation is formed, or, when the temperature sensor 120 detects a temperature below 3° C. as an example of a predetermined temperature, the condition of freezing operation is formed without relating to a detected temperature of the temperature sensor 118. In this freezing prevention combustion, the freezing prevention combustion for settled time (for example, the combustion for four (4) seconds by the all-combustion minimum combustion) is performed, and heating of the primary heat exchanger 30 is performed. At this time, the interval time is reset (a step S7).

Further, after the freezing prevention combustion, the fan motor 68 is continuously rotated, and the post-purge is started by the air supply fan 66 (a step S8). By this, heating of the secondary heat exchanger 32 is performed by the remaining heat of the primary heat exchanger 30.

Furthermore, after the freezing prevention combustion, a count of the interval time is performed (a step S9). In this case, the count of the interval time is performed also during the post-purge. By this count of the interval time, whether or not the interval time exceeds thirty (30) seconds as an example of a minimum post-purge time is observed (a step S10). If the interval time does not exceed the minimum post-purge time, the count of the interval time is continued. When the minimum post-purge time passes, whether or not three hundred (300) seconds as an example of a maximum post-purge time passes is observed (a step S11). When the maximum post-purge time does not pass, a detected temperature of the temperature sensor 120 is observed, and whether or not the detected temperature is below 15° C. as an example of a predetermined temperature is decided (a step S12). When the detected temperature is not below 15° C. as an example of the predetermined temperature, the freezing prevention control is returned to the step S9, and the processing of the steps S9 through S12 is repeated. On the other hand, when the maximum post-purge time passes, or when the detected temperature of the temperature sensor 120 falls to a temperature below 15° C. as an example of the predetermined temperature, the fan motor 68 is stopped, and the post-purge by the air supply fan 66 is stopped (a step S13). After that, the freezing prevention control is returned to the step S1, and the control is continuously repeated.

In this case, although the minimum time and the maximum time are set as a time period of the fan motor 68 (the post-purge) after the freezing prevention combustion, in case of a time period below the maximum time, it is fixed up to a time period that the temperature of the primary heat exchanger 30 becomes a temperature below the threshold temperature. As a result of this, on a condition that the temperature of the primary heat exchanger 30 is high, it is possible to send much more remaining heat to the secondary heat exchanger 32, and the freezing prevention may be given by heating of the secondary heat exchanger 32.

MODIFIED EXAMPLES

In connection with the embodiment described above, modified examples thereof are enumerated in the following.

In the above-mentioned embodiment, the control part which executes the control such as freezing prevention control, the remote-control unit and so on may also be installed in the outside of the hot-water supply apparatus.

In the above-mentioned embodiment, the ROM which is provided inside the hot-water supply apparatus is exemplified as a storage storing the hot-water supply control program and the freezing prevention control program. However, a storage unit of an outside of the hot-water supply apparatus may also be used as a storing place of these programs.

Example of Experiment

Figure 12:
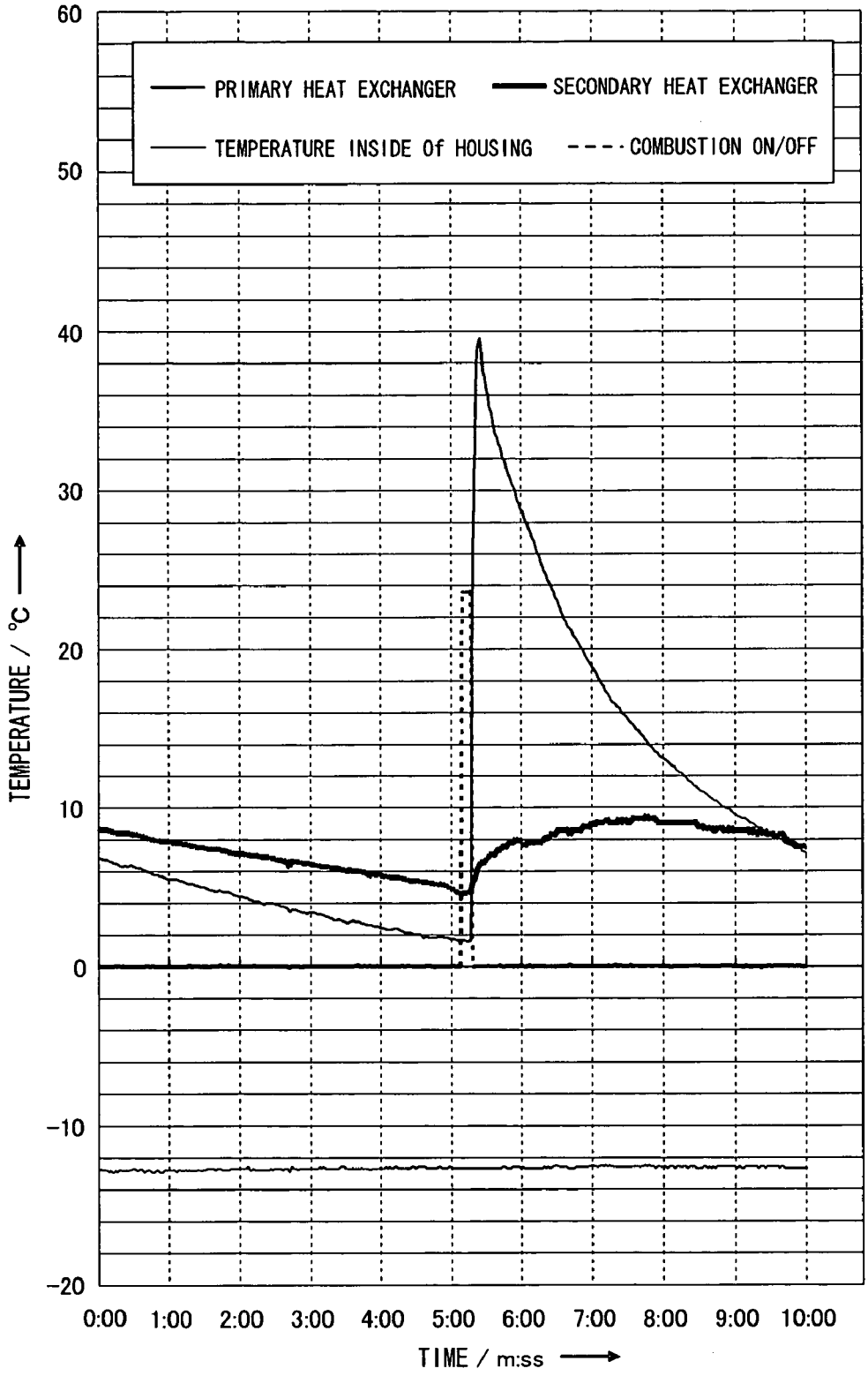
FIG. 12 is a drawing showing an effect of keeping warmth by means of combustion and a post-purge.
Figure 13:
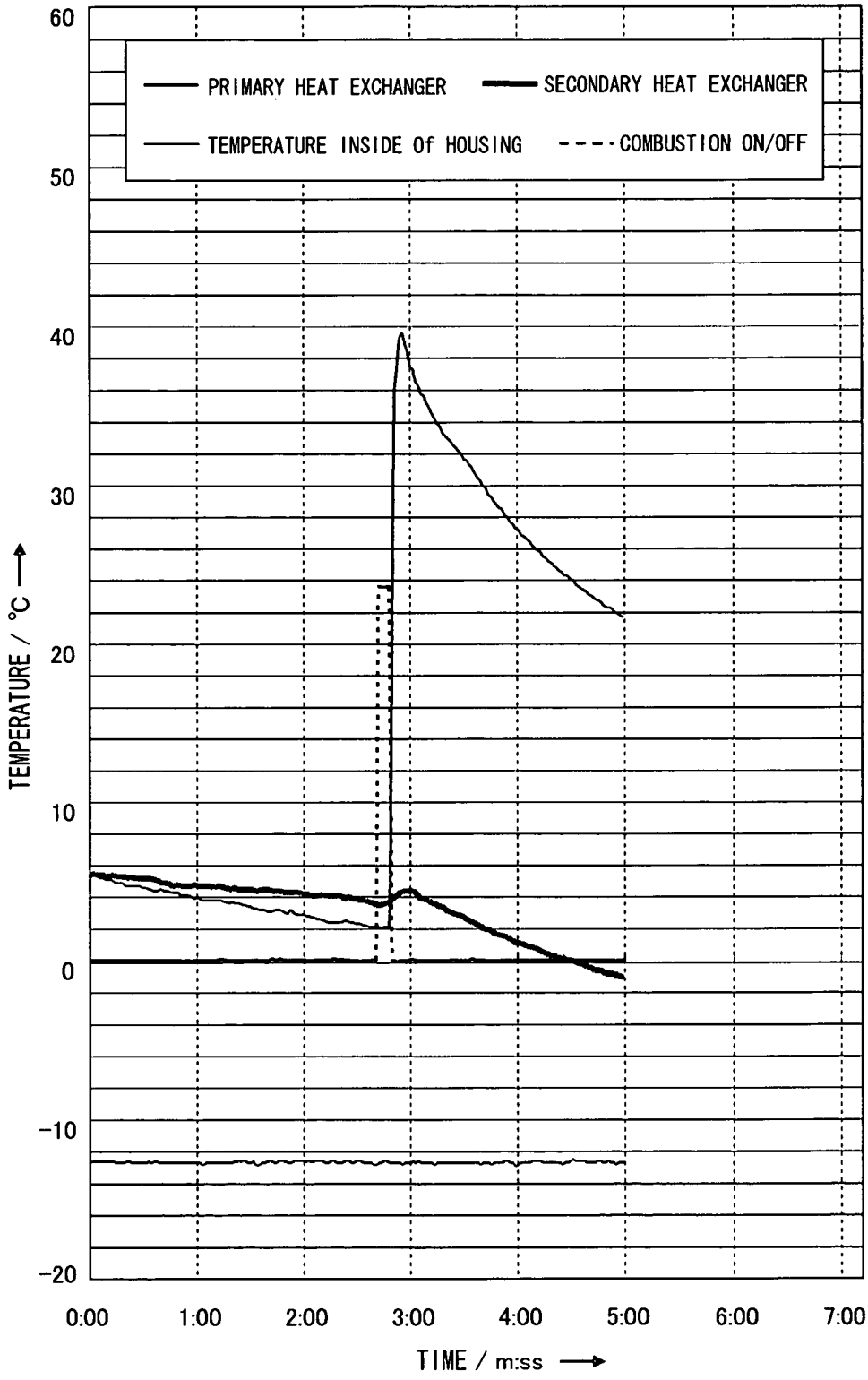
FIG. 13 is a drawing showing an effect of keeping warmth by means of only the combustion.

Next, an example of an experiment of the hot-water supply apparatus and the anti-freezing method according to the present invention is explained by referring to FIG. 12 and FIG. 13. FIG. 12 is a drawing showing an effect of keeping warmth by means of combustion and a post-purge, and FIG. 13 is a drawing showing an effect of keeping warmth by means of only the combustion.

An experimental condition is the temperature: −13° C., the adverse wind: 5 [m/sec], the all-combustion minimum combustion as a condition of the freezing prevention combustion: four (4) seconds, the post-purge: sixty (60) seconds, and the rotating speed of the fan motor: 4100 [rpm]. Experimental contents are as follows. The hot-water supply apparatus, which is a product, is installed in a refrigerator, the adverse wind (the cold wind) is sent from the exhaust chimney, and the variation in temperature of the heat exchangers at this time are observed. Further, when the lowest temperature of the primary heat exchanger becomes a temperature below 3° C., the all-combustion minimum combustion is performed for four (4) seconds, and the primary heat exchanger and the secondary heat exchanger are heated.

According to the experimental result shown in FIG. 12, the secondary heat exchanger is heated by remaining heat of the primary heat exchanger due to the post-purge. As a result, as is clear from comparison between FIG. 12 and FIG. 13, it will be understood that in FIG. 12 a rise of the temperature of the secondary heat exchanger further occurs, and keeping warmth is improved.

In addition, although in the embodiment the hot-water supply apparatus which performs the hot-water supply is explained as an example, the present invention can be applied to a heat source apparatus which consist of hot-water supply, reheating or heating function.

Although the best mode for carrying out the invention, the object, the configuration and the operation and effect have been described in detail above, the invention is not limited to such embodiment for carrying out the invention, and it is a matter of course that the invention can be variously changed or modified by a person skilled in the art on the basis of a gist and split of the invention as disclosed in claims and the detailed description of the invention, and such a change or modification, and various conjectured configurations, modified examples and so forth are included in the scope of the invention, and the description of the specification and drawings are not restrictively understood.

The entire disclosure of Japanese Patent Application No. 2004-231650 including specification, claims, drawings and summary are incorporated herein by reference in its entirety.

What is claimed is:

1. A hot-water supply apparatus having a primary heat exchanger, which absorbs sensible heat of combustion exhaust generated by combustion of fuel, and a secondary heat exchanger which absorbs latent heat of said combustion exhaust, comprising:

a temperature detection means that detects a temperature of an inside of said hot-water supply apparatus;

a combustion means that supplies said combustion exhaust to said primary heat exchanger and said secondary heat exchanger;

an air supply means that supplies air to said combustion means; and a control means that makes said combustion means burn and drives said air supply means based on a detected temperature of said temperature detection means;

a freezing prevention temperature that forms reference of a start of freezing prevention operation being set for the control means, and, in case where a detected temperature of said temperature detection means reaches said freezing prevention temperature, said control means making said combustion means burn for a settled time to heat said primary heat exchanger, and driving said air supply means to stream air from a side of said primary heat exchanger to said secondary heat exchanger for a given time after a combustion stop of said combustion means.

2. The hot-water supply apparatus of claim 1, wherein a side of said secondary heat exchanger is heated by means of remaining heat, which a side of said primary heat exchanger has, by streaming air from the side of said primary heat exchanger to said secondary heat exchanger.

3. The hot-water supply apparatus of claim 1, wherein said temperature detection means detects a temperature of a water pipe which said primary heat exchanger or said secondary heat exchanger has, or detects a temperature of a water pipe which is connected to said primary heat exchanger or said secondary heat exchanger.

4. The hot-water supply apparatus of claim 1 further comprising:

heaters that heat a water pipe supplying water to said primary heat exchanger and said secondary heat exchanger; and a temperature detection means that detects a temperature of a space of an inside of a housing of said hot-water supply apparatus, said control means feeding said heaters to heat said water pipe in case where a detected temperature of the space of the inside of the housing by means of said temperature detection means reaches said freezing prevention temperature.

5. The hot-water supply apparatus of claim 1, wherein a drive time of said air supply means is controlled according to the detected temperature of said temperature detection means.

6. The hot-water supply apparatus of claim 1 further comprising:

a temperature detection means that detects a temperature of a space in which said hot-water supply apparatus is installed; and an air supply means that supplies air of said space to said combustion means, said control means driving said air supply means to stream the air of said space to said primary heat exchanger and said secondary heat exchanger in case where the temperature of said space is higher than said freezing prevention temperature.

7. A hot-water supply apparatus having a primary heat exchanger, which absorbs sensible heat of combustion exhaust generated by combustion of fuel, and a secondary heat exchanger which absorbs latent heat of said combustion exhaust, comprising:

a first temperature detection means that detects a temperature of a water pipe of an entrance water side;

a second temperature detection means that detects a temperature of a water pipe of an outgoing hot-water side;

a combustion means that supplies said combustion exhaust to said primary heat exchanger and said secondary heat exchanger;

an air supply means that supplies air to said combustion means; and a control means that makes said combustion means burn and drives said air supply means based on a detected temperature of said first temperature detection means or said second temperature detection means;

a freezing prevention temperature that forms reference of a start of freezing prevention operation being set for the control means, and, in case where either a detected temperature of said first temperature detection means or a detected temperature of said second temperature detection means reaches said freezing prevention temperature, or in case where both of them reach said freezing prevention temperature, said control means making said combustion means burn for a settled time to heat said primary heat exchanger, and driving said air supply means to stream air from a side of said primary heat exchanger to said secondary heat exchanger for a given time after a combustion stop of said combustion means.

8. The hot-water supply apparatus of claim 7, wherein a side of said secondary heat exchanger is heated by means of remaining heat, which a side of said primary heat exchanger has, by streaming air from the side of said primary heat exchanger to said secondary heat exchanger.

9. An anti-freezing method of a hot-water supply apparatus having a primary heat exchanger, which absorbs sensible heat of combustion exhaust generated by combustion of fuel, and a secondary heat exchanger which absorbs latent heat of said combustion exhaust, comprising:

processing that sets a freezing prevention temperature which forms reference of a start of freezing prevention operation;

processing that detects a temperature of an inside of said hot-water supply apparatus;

processing that supplies combustion exhaust, which is generated at a combustion means by combustion of fuel, to said primary heat exchanger and said secondary heat exchanger;

processing that supplies air necessary for combustion to said combustion means by an air supply means; and processing that makes said combustion means burn for a settled time to heat said primary heat exchanger in case where said freezing prevention temperature is detected, and drives said air supply means to stream air from a side of said primary heat exchanger to said secondary heat exchanger for a given time after a combustion stop of said combustion means.

10. The anti-freezing method of the hot-water supply apparatus of claim 9, wherein a side of said secondary heat exchanger is heated by means of remaining heat, which a side of said primary heat exchanger has, by streaming air from the side of said primary heat exchanger to said secondary heat exchanger.

11. The anti-freezing method of the hot-water supply apparatus of claim 9, wherein said freezing prevention temperature is detected by a temperature of a water pipe which said primary heat exchanger or said secondary heat exchanger has, or is detected by a temperature of a water pipe which is connected to said primary heat exchanger or said secondary heat exchanger.

12. The anti-freezing method of the hot-water supply apparatus of claim 9, wherein said temperature of the inside of the hot-water supply apparatus is a temperature of a space of an inside of a housing of said hot-water supply apparatus, and further including processing that heats a water pipe supplying water to said primary heat exchanger and said secondary heat exchanger by electric heating in case where the temperature of the space of the inside of the housing of said hot-water supply apparatus reaches said freezing prevention temperature.

13. The anti-freezing method of the hot-water supply apparatus of claim 9 further including processing that makes a drive time of said air supply means increase/decrease according to a detected temperature of the inside of the hot-water supply apparatus.

14. The anti-freezing method of the hot-water supply apparatus of claim 9 further including processing that streams air of a space, in which said hot-water supply apparatus is installed, to said primary heat exchanger and said secondary heat exchanger in case where a temperature of said space is higher than said freezing prevention temperature.

15. An anti-freezing method of a hot-water supply apparatus having a primary heat exchanger, which absorbs sensible heat of combustion exhaust generated by combustion of fuel, and a secondary heat exchanger which absorbs latent heat of said combustion exhaust, comprising:

processing that sets a freezing prevention temperature which forms reference of a start of freezing prevention operation;

processing that detects a first temperature of a water pipe of an entrance water side;

processing that detects a second temperature of a water pipe of an outgoing hot-water side;

processing that supplies combustion exhaust, which is generated at a combustion means by combustion of fuel, to said primary heat exchanger and said secondary heat exchanger;

processing that supplies air necessary for combustion to said combustion means by an air supply means; and processing that makes said combustion means burn for a settled time to heat said primary heat exchanger in case where either said first temperature or said second temperature reaches said freezing prevention temperature, or in case where both of them reach said freezing prevention temperature, and drives said air supply means to stream air from a side of said primary heat exchanger to said secondary heat exchanger for a given time after a combustion stop of said combustion means.

16. The anti-freezing method of the hot-water supply apparatus of claim 15, wherein a side of said secondary heat exchanger is heated by means of remaining heat, which a side of said primary heat exchanger has, by streaming air from the side of said primary heat exchanger to said secondary heat exchanger.

17. An anti-freezing program on a computer readable medium of a hot-water supply apparatus having a primary heat exchanger, which absorbs sensible heat of combustion exhaust generated by combustion of fuel, and a secondary heat exchanger which absorbs latent heat of said combustion exhaust, and making a computer execute the following steps, comprising:

a step that obtains a temperature data of an inside of said hot-water supply apparatus, which is detected by a temperature detection means;

a step that makes a comparison between a temperature of the inside of said hot-water supply apparatus and a freezing prevention temperature which forms reference of a start of freezing prevention operation;

a step that drives a combustion means for a settled time for the purpose of heating said primary heat exchanger in case where said temperature of the inside of the hot-water supply apparatus reaches said freezing prevention temperature; and a step that drives an air supply means for a given time after a stop of drive of said combustion means for the purpose of streaming air from a side of said primary heat exchanger to said secondary heat exchanger.

18. The anti-freezing program of the hot-water supply apparatus of claim 17, wherein said temperature data of the inside of the hot-water supply apparatus, which is detected by said temperature detection means, is a temperature data of a water pipe which said primary heat exchanger or said secondary heat exchanger has, or is a temperature data of a water pipe which is connected to said primary heat exchanger or said secondary heat exchanger.

19. The anti-freezing program of the hot-water supply apparatus of claim 17, wherein said temperature data of the inside of the hot-water supply apparatus, which is detected by said temperature detection means, is a temperature data of a space of an inside of a housing of said hot-water supply apparatus, and further including a step that drives heaters heating a water pipe supplying water to said primary heat exchanger and said secondary heat exchanger in case where a temperature of the space of the inside of the housing of said hot-water supply apparatus reaches said freezing prevention temperature.

20. The anti-freezing program of the hot-water supply apparatus of claim 17 further including a step that makes a drive time increase/decrease according to a detected temperature of the inside of the hot-water supply apparatus and drives said air supply means.

21. The anti-freezing program of the hot-water supply apparatus of claim 17 further including:

a step that obtains a temperature data of a space in which said hot-water supply apparatus is installed, said temperature data being detected by a temperature detection means; and a step that drives an air supply means, which streams air of said space to said primary heat exchanger and said secondary heat exchanger, in case where a temperature of said space is higher than said freezing prevention temperature.

22. An anti-freezing program on a computer readable medium of a hot-water supply apparatus having a primary heat exchanger, which absorbs sensible heat of combustion exhaust generated by combustion of fuel, and a secondary heat exchanger which absorbs latent heat of said combustion exhaust, and making a computer execute the following steps, comprising:

a step that obtains a first temperature data of a water pipe of an entrance water side;

a step that obtains a second temperature data of a water pipe of an outgoing hot-water side;

a step that makes a comparison between said first and second temperatures and a freezing prevention temperature which forms reference of a start of freezing prevention operation;

a step that drives a combustion means for a settled time for the purpose of heating said primary heat exchanger in case where either said first temperature or said second temperature reaches said freezing prevention temperature, or in case where both of them reach said freezing prevention temperature; and a step that drives an air supply means for the purpose of streaming air from a side of said primary heat exchanger to said secondary heat exchanger for a given time after a stop of drive of said combustion means.

* * * * *